US009862208B2

(12) United States Patent
Furukawa

(10) Patent No.: US 9,862,208 B2
(45) Date of Patent: Jan. 9, 2018

(54) IMAGE FORMING APPARATUS, RECORDING MEDIUM TRANSPORTATION DEVICE, AND RECORDING MEDIUM TRANSPORTATION METHOD

(71) Applicant: FUJIFILM Corporation, Tokyo (JP)

(72) Inventor: Koji Furukawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/207,956

(22) Filed: Jul. 12, 2016

(65) Prior Publication Data

US 2016/0318315 A1 Nov. 3, 2016

Related U.S. Application Data

(63) Continuation of application No. PCT/JP2014/073122, filed on Sep. 3, 2014.

(30) Foreign Application Priority Data

Feb. 26, 2014 (JP) ..... 2014-035091

(51) Int. Cl.
*B41J 29/38* (2006.01)
*B41J 13/00* (2006.01)
(Continued)

(52) U.S. Cl.
CPC ..... *B41J 13/0009* (2013.01); *B41J 2/01* (2013.01); *B41J 11/0085* (2013.01); *B41J 13/226* (2013.01)

(58) Field of Classification Search
None
See application file for complete search history.

(56) References Cited

U.S. PATENT DOCUMENTS 5,835,839 A * 11/1998 Kaneda ..... B65H 29/242 399/361
6,254,081 B1 7/2001 Rasmussen et al.
(Continued)

FOREIGN PATENT DOCUMENTS

JP 2001-019219 A 1/2001
JP 2009-242064 A 10/2009
(Continued)

OTHER PUBLICATIONS

International Search Report issued in PCT/JP2014/073122; dated Nov. 18, 2014.
(Continued)

*Primary Examiner* — Matthew Luu
*Assistant Examiner* — Tracey McMillion
(74) *Attorney, Agent, or Firm* — Studebaker & Brackett PC

(57) ABSTRACT

A thickness of a recording medium to be held in a holding region of an outer circumferential part of a cylindrical portion having plural suction holes and a suction position positioned in a predetermined direction from a position of a shaft is acquired. In a case where the thickness of the recording medium is equal to or greater than a first threshold value, a suction flow rate of each suction hole disposed in a subsequent region other than a leading edge of the recording medium is set as a first suction flow rate, and a suction flow rate of each suction hole disposed in the leading edge is set as a second suction flow rate which is smaller than the first suction flow rate. In a case where the thickness of the recording medium is smaller than the first threshold value, a suction flow rate of each suction hole disposed in the holding region is set as a third flow rate which is smaller than the first flow rate.

15 Claims, 11 Drawing Sheets

(51) Int. Cl.

| | |
|---|---|
| ***B41J 13/22*** | (2006.01) |
| ***B41J 2/01*** | (2006.01) |
| ***B41J 11/00*** | (2006.01) |

(56) References Cited

U.S. PATENT DOCUMENTS

| | | | | |
|---|---|---|---|---|
| 2003/0058326 | A1* | 3/2003 | Araki | B41F 19/062 347/217 |
| 2009/0290008 | A1 | 11/2009 | Fukui | |
| 2010/0177152 | A1* | 7/2010 | Fukui | B41J 2/14233 347/104 |
| 2011/0025807 | A1 | 2/2011 | Fukui | |
| 2013/0027492 | A1* | 1/2013 | Yoneyama | B41J 13/076 347/104 |
| 2013/0215204 | A1* | 8/2013 | Inoue | B41F 21/10 347/104 |

FOREIGN PATENT DOCUMENTS

| | | | |
|---|---|---|---|
| JP | 2009-279795 | A | 12/2009 |
| JP | 2011-032037 | A | 2/2011 |
| JP | 2013-169719 | A | 9/2013 |

OTHER PUBLICATIONS

International Preliminary Report on Patentability issued in PCT/JP2014/073122; dated Aug. 18, 2015.

* cited by examiner

IMAGE FORMING APPARATUS, RECORDING MEDIUM TRANSPORTATION DEVICE, AND RECORDING MEDIUM TRANSPORTATION METHOD

CROSS-REFERENCE TO RELATED APPLICATIONS

This application is a Continuation of PCT International Application No. PCT/JP2014/073122 filed on Sep. 3, 2014, which claims priority under 35 U.S.C. §119 (a) to Japanese Patent Application No. 2014-035091 filed on Feb. 26, 2014. Each of the above application(s) is hereby expressly incorporated by reference, in its entirety, into the present application.

BACKGROUND OF THE INVENTION

1. Field of the Invention

The present invention relates to an image forming apparatus, a recording medium transportation device, and a recording medium transportation method, and particularly relates to a technique that suctions and transports a recording medium on a circumferential surface of a cylindrical transportation body.

2. Description of the Related Art

As a recording medium transportation device that fixes and transports a recording medium, a suction transportation device that suctions the recording medium on a circumferential surface of a cylindrical drum from the inside of the cylindrical drum through suction holes provided on the circumferential surface of the cylindrical drum to fix and hold the recording medium and transports the recording medium which is fixed and held by rotating the cylindrical drum is known (for example, JP2009-242064A).

In such a suction transportation device, in a case where plural sheets are fixed and held on the cylindrical drum at one time, an air flow rate is determined on the premise that suction holes positioned behind a trailing edge of an arbitrary sheet are blocked by a sheet subsequent to the former sheet. However, with respect to a final sheet without a subsequent sheet, since suction holes by which the subsequent sheet is to be fixed and held are not blocked, air for suctioning leaks from the suction holes. Further, since there is a transportation interval between plural sheets, there is a case where suction holes are not blocked at a position between the sheets, and air leaks. As a result, in the case of a thick sheet having a high stiffness, there is a problem in that it is not possible to appropriately suction a trailing edge region of a final sheet.

SUMMARY OF THE INVENTION

In order to solve the above-mentioned problems, a technique of reducing the amount of air that leaks when suction holes are not blocked by reducing an air flow rate in a leading edge region of a sheet may be considered. However, if the air flow rate in the leading edge region of a sheet is reduced, in a case where a sheet such as a sheet having a high air permeability such as a thin sheet or an uncoated sheet is transported, there is a problem in that lifting of a sheet occurs in the leading edge region.

In order to solve the above-mentioned problems, an object of the invention is to provide an image forming apparatus, a recording medium transportation device, and a recording medium transportation method capable of appropriately performing suction and transportation regardless of types of recording medium.

According to an aspect of the invention, there is provided a recording medium transportation device comprising: a cylindrical portion that holds a recording medium in a holding region on an outer circumferential surface thereof and is rotated around a shaft, and that has a suction position positioned in a predetermined direction from the position of the shaft; a plurality of suction holes that are disposed in the holding region; a suction unit for suctioning the recording medium through suction holes disposed at the suction position among the plurality of suction holes; an adjustment unit disposed between the plurality of suction holes and the suction unit, the adjustment unit capable of adjusting a suction flow rate of each suction hole; an acquisition unit for acquiring the thickness of the recording medium to be held in the holding region; a determination unit for determining whether the acquired thickness is equal to or greater than a first threshold value; and a control unit for controlling the plurality of adjustment unit to set the suction flow rate when the holding region is present at the suction position, that sets, as a first rate, a suction flow rate of a suction hole disposed in a subsequent region other than a leading edge which is a preceding region according to rotation of the cylindrical portion in the holding region and sets, as a second flow rate which is smaller than the first flow rate, a suction flow rate of a suction hole disposed in the leading edge in a case where the acquired thickness is equal to or greater than the first threshold value, and sets, as a third flow rate which is smaller than the first flow rate, a suction flow rate of a suction hole disposed in the holding region in a case where the acquired thickness is smaller than the first threshold value.

According to this aspect of the invention, in a recording medium of which the thickness is equal to or greater than the first threshold value, it is possible to prevent separation of a trailing edge of a recording medium which is finally transported. Further, in a recording medium of which the thickness is smaller than the first threshold value, it is possible to prevent lifting of a leading edge of a recording medium.

It is preferable that the cylindrical portion comprises a plurality of suction passages which extend from a side surface of the cylindrical portion in an axial direction of the cylindrical portion inwards from the outer circumferential surface of the cylindrical portion and communicate with the suction holes, which is arranged along a circumferential direction of the cylindrical portion, the suction unit comprises a vacuum chamber that communicates with a suction passage corresponding to a suction hole at the suction position among the plurality of suction passages, and a pump that evacuates the vacuum chamber, and the adjustment unit comprises a plurality of valves that are respectively disposed between the plurality of suction passages and the vacuum chamber. Thus, it is possible to appropriately control the suction flow rate.

It is preferable that the chamber comprises a first vacuum chamber that communicates with each of the plurality of suction passages and is rotated according to rotation of the cylindrical portion, and a second vacuum chamber that communicates with a suction passage disposed at the suction position among the plurality of suction passages that communicates with the first vacuum chamber. Thus, it is possible to appropriately secure communication with suction passages corresponding to suction holes at the suction position among the plurality of suction passages.

It is preferable that the second suction flow rate is equal to or greater than ⅙ of the first suction flow rate and is equal to or smaller than ½ of the first suction flow rate. Thus, it is possible to appropriately suction a recording medium.

It is preferable that the determination unit determines whether the acquired thickness is equal to or greater than a second threshold value which is smaller than the first threshold value, and the control unit sets the suction flow rate of the suction hole disposed in the holding region as a fourth suction flow rate which is smaller than the second suction flow rate and the third suction flow rate in a case where the acquired thickness is smaller than the second threshold value. Thus, it is possible to appropriately perform suction even in a recording medium of which the thickness is smaller than the second threshold value.

The acquisition unit may comprise an input unit through which the thickness of the recording medium to be held in the holding region is input, and the acquisition unit may comprise a sensor that measures the thickness of the recording medium to be held in the holding region. Thus, it is possible to appropriately acquire the thickness of a recording medium.

Where the number of holding regions is represented as n, the radius of the cylindrical portion is represented as r, a circumferential length of the recording medium to be held in the holding region is represented as $L_P$, and a circumferential length of the suction position on the cylindrical portion is represented as $L_D$, the leading edge region may be represented as a region ranging from a preceding end portion according to rotation of the cylindrical portion in the holding region to a position spaced apart therefrom by a distance $L_N$ expressed by $L_N=L_D+L_P-2\pi r/n$ along a circumferential direction of the cylindrical portion. By defining the leading edge as described above, it is possible to appropriately suction a recording medium of which the thickness is equal to or greater than the first threshold value.

The recording medium transportation device further comprise a grip unit for gripping a preceding end portion of the recording medium according to rotation of the cylindrical portion. Thus, it is possible to fix the position of a leading edge of a recording medium, and to position the recording medium on the outer circumferential surface of the cylindrical portion.

The cylindrical portion may hold the recording medium in each of the plurality of holding regions. According to this aspect of the invention, it is possible to appropriately use the recording medium transportation device even in a case where a cylindrical portion having plural holding regions is used. That is, it is possible to prevent separation of a trailing edge of a recording medium which is finally transported, and to prevent lifting of a leading edge of a recording medium of which the thickness is smaller than the first threshold value.

According to another aspect of the invention, there is provided an image forming apparatus including: a recording medium transportation device; an inkjet head that is provided to face the suction position; and a recording unit for recording an image by discharging ink from the inkjet head onto a recording medium held in the holding region on the outer circumferential surface of the cylindrical portion. The recording medium transportation device comprises: a cylindrical portion that holds a recording medium in a holding region on an outer circumferential surface thereof and is rotated around a shaft, the cylindrical portion having a suction position positioned in a predetermined direction from the position of the shaft; a plurality of suction holes that is disposed in the holding region; a suction unit for suctioning the recording medium through suction holes disposed at the suction position among the plurality of suction holes; an adjustment unit disposed between the plurality of suction holes and the suction unit, the adjustment unit capable of adjusting a suction flow rate of each suction hole; an acquisition unit for acquiring the thickness of the recording medium to be held in the holding region; a determination unit for determining whether the acquired thickness is equal to or greater than a first threshold value; and a control unit for controlling the plurality of adjustment unit to set the suction flow rate when the holding region is present at the suction position, the control unit setting, as a first rate, a suction flow rate of a suction hole disposed in a subsequent region other than a leading edge which is a preceding region according to rotation of the cylindrical portion in the holding region and setting, as a second flow rate which is smaller than the first flow rate, a suction flow rate of a suction hole disposed in the leading edge in a case where the acquired thickness is equal to or greater than the first threshold value, and setting, as a third flow rate which is smaller than the first flow rate, a suction flow rate of a suction hole disposed in the holding region in a case where the acquired thickness is smaller than the first threshold value.

In an image forming apparatus that records an image by discharging ink from an inkjet head, it is necessary that a recording medium is appropriately held along a cylindrical portion. The recording medium transportation device according to this aspect of the invention may be applied to an image forming apparatus that uses an inkjet head to appropriately record an image.

According to a still another aspect of the invention, there is provided a recording medium transportation method using a transportation body including a cylindrical portion that holds a recording medium in a holding region on an outer circumferential surface thereof, is rotated around a shaft, and has a plurality of suction holes in the holding region and a suction position positioned always in a predetermined direction from the position of the shaft, the plurality of suction holes disposed in the holding region, and a plurality of suction passages which extends from a side surface of the cylindrical portion in an axial direction of the cylindrical portion inwards from the outer circumferential surface of the cylindrical portion, communicates with the suction holes, and is arranged along a circumferential direction of the cylindrical portion, the method including: an acquisition step of acquiring the thickness of the recording medium to be held in the holding region; a determination step of determining whether the acquired thickness is equal to or greater than a first threshold value; a setting step of setting a suction flow rate of each suction hole when the holding region is present at the suction position, the setting step including setting, as a first flow rate, a suction flow rate of a suction hole disposed in a subsequent region other than a leading edge which is a preceding region according to rotation of the cylindrical portion in the holding region and setting, as a second flow rate which is smaller than the first flow rate, a suction flow rate of a suction hole disposed in the leading edge in a case where the acquired thickness is equal to or greater than the first threshold value, and setting, as a third flow rate which is smaller than the first flow rate, a suction flow rate of a suction hole disposed in the holding region in a case where the acquired thickness is smaller than the first threshold value; and a transportation step of rotating the cylindrical portion with the recording medium being held in the holding region to suction the recording medium through suction holes at the suction position among the plurality of suction holes.

According to this aspect of the invention, in a recording medium of which the thickness is equal to or greater than the first threshold value, it is possible to prevent separation of a trailing edge of a recording medium which is finally transported. Further, in a recording medium of which the thickness is smaller than the first threshold value, it is possible to prevent lifting of a leading edge of a recording medium.

According to the invention, it is possible to appropriately perform suction and transportation regardless of types of recording medium.

DESCRIPTION OF THE PREFERRED EMBODIMENTS

Hereinafter, preferred embodiments of the invention will be described with reference to the accompanying drawings.

First Embodiment

[Outline of Sheet Transportation Device]

Figure 1:
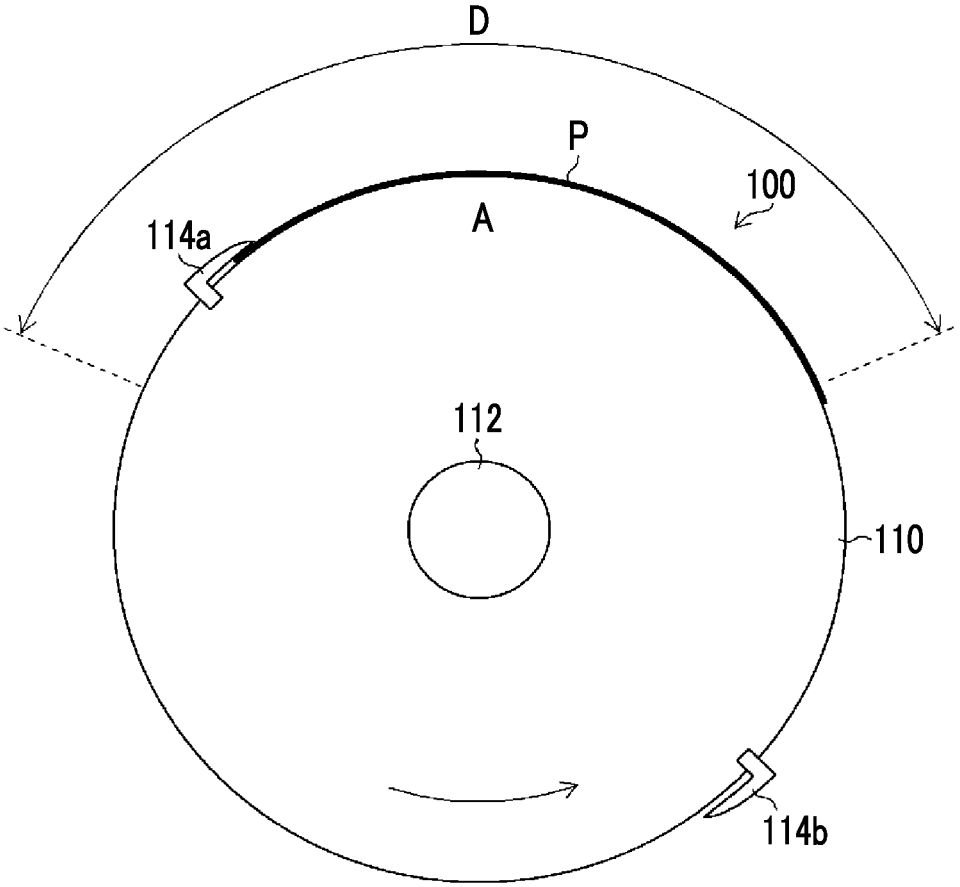
FIG. 1 is a schematic view of a sheet transportation device 100.

A recording medium transportation device according to a first embodiment will be described. As shown in FIG. 1, a sheet transportation device 100 which is an example of the recording medium transportation device comprises a drum 110 (an example of a cylindrical portion). The drum 110 is fixed to a rotating shaft 112, and rotates around the rotating shaft 112.

At positions on an outer circumferential surface with the rotating shaft 112 of the drum 110 being interposed therebetween, two grippers (grip unit) 114*a* and 114*b* for gripping a leading edge of each sheet P which is a sheet recording medium (an edge portion on a preceding side according to rotation of the drum 110 among edge portions of the held sheet P) are provided.

Further, a suction position D disposed always in a constant direction with respect to the position of the rotating shaft 112 regardless of the rotation of the drum 110 is provided on the drum 110. The drum 110 suctions and holds the sheet P at the suction position D onto the outer circumferential surface of the drum 110.

The sheet transportation device 100 grips the leading edge of the sheet P by the grippers (grip unit) 114*a* and 114*b* to hold the sheet P on the outer circumferential surface of the drum 110. The leading edge position of the sheet P is fixed by the grippers (grip unit) 114*a* and 114*b* to be positioned on the outer circumferential surface of the drum 110.

The sheet transportation device 100 rotates the drum 110 around the rotating shaft 112 in a state where the sheet P is positioned, to thereby transport the sheet P. The sheet transportation device 100 is able to transport two sheets P using two grippers (grip unit) 114*a* and 114*b* in one revolution.

Figure 2:
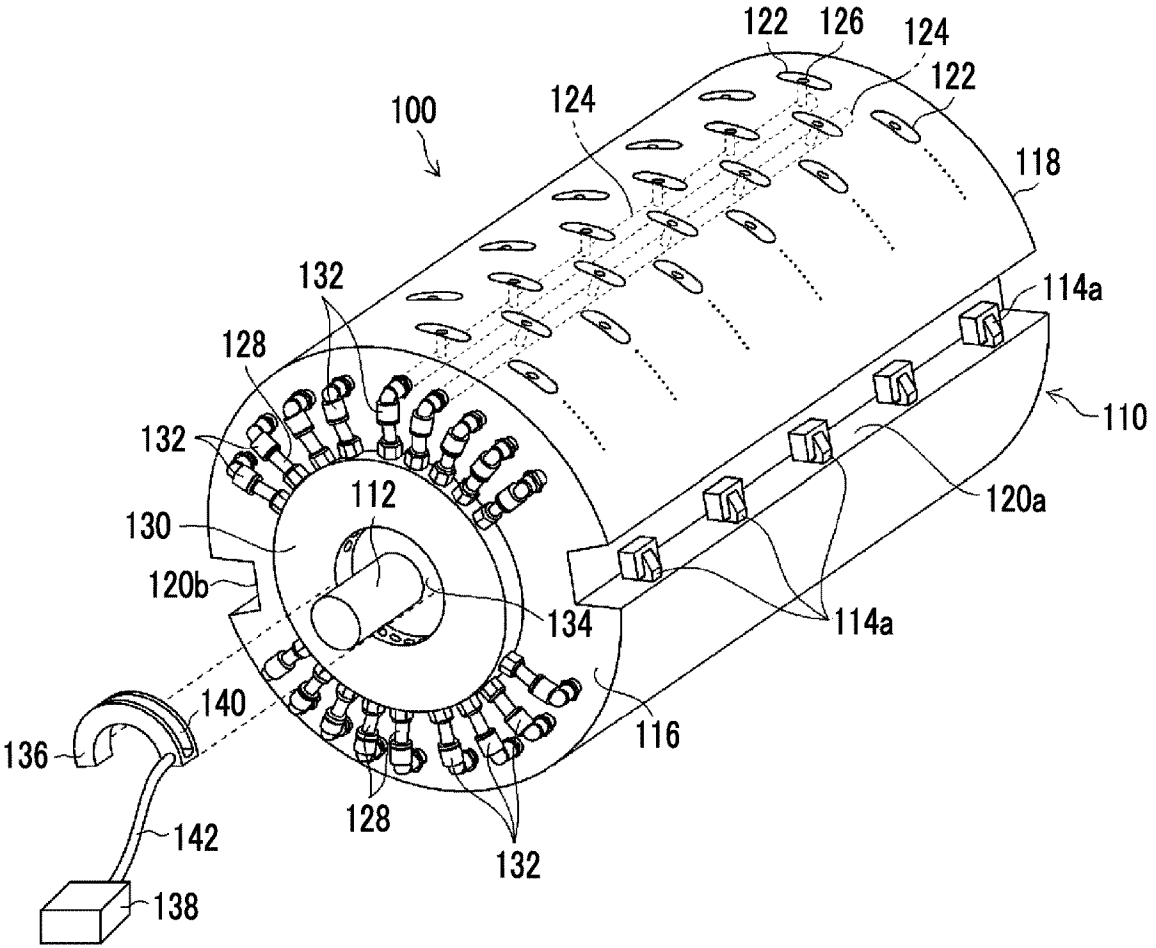
FIG. 2 is a perspective view of the sheet transportation device 100.

As shown in FIG. 2, side surfaces of the cylindrical drum 110 are closed by round plates 116 and 118 of the cylindrical drum 110, and the rotating shaft 112 passes through central portions of the round plates 116 and 118.

On the outer circumferential surface of the drum 110, trapezoidal cut portions 120*a* and 120*b* are formed along an extending direction of the rotating shaft 112 (hereinafter, referred to as an axial direction) at an interval of 180° in a side view. Plural grippers (grip unit) 114*a* are arranged in the cut portion 120*a*, and plural grippers (grip unit) 114*b* (not shown in FIG. 2, see FIG. 1) are arranged in the cut portion 120*b*.

Further, on the outer circumferential of the drum 110, plural long grooves 122 (an example of suction holes) that extend in a direction along the rotating direction of the drum 110 (hereinafter, referred to as a circumferential direction) are formed along the axial direction of the drum 110. The plural long grooves 122 are arranged to be deviated from each other in the circumferential direction, and are arranged so that edge portions of the long grooves 122 which are adjacent in the circumferential direction overlap each other in the axial direction.

Further, in the drum 110, plural columnar suction passages 124 (an example of a suction passages) extend from a side surface of the drum 110 in the axial direction of the drum 110 inwards from the outer circumferential surface of the drum 110. The plural suction passages 124 are arranged along the circumferential direction of the drum 110. In addition, a round hole 126 is formed at a central portion of each long groove 122, and the long groove 122 and the suction passage 124 communicate with each other through the round hole 126 (see FIG. 3).

Each suction passage 124 is closed by the round plate 118 on one side surface of the drum 110, and passes through the round plate 116 on the other side surface. A tube 128 is provided on the round plate 116 to correspond to each suction passage 124, and the respective tubes 128 communicate with a rotating vacuum chamber 130 disposed on the round plate 116.

Further, a valve 132 is provided on each tube 128. That is, each valve 132 is arranged between the suction passage 124 and the rotating vacuum chamber 130.

The rotating vacuum chamber 130 (an example of a first vacuum chamber) has an annular shape delimited by an outer wall and an inner wall, and a bottom surface thereof is arranged to be in contact with the round plate 116. Further, the rotating shaft 112 is arranged at the center of a hollow portion 134 formed by the inner wall of the rotating vacuum chamber 130.

Each tube 128 passes through the inner wall of the rotating vacuum chamber 130 from the outer wall thereof to communicate with the hollow portion 134. In addition, an arc-shaped stop vacuum chamber 136 is disposed in the hollow portion 134.

The round plate 116, the tube 128, and the rotating vacuum chamber 130 rotate around the rotating shaft 112 according to the rotation of the drum 110. On the other hand, the stop vacuum chamber 136 is stopped regardless of the rotation or non-rotation of the drum 110 with an upper surface thereof being fixed to be in close contact with the inner wall of the rotating vacuum chamber 130.

A pump 138 is connected to the stop vacuum chamber 136 (an example of a second vacuum chamber) through a tube 142, and the pump 138 communicates with a hole portion 140 formed on the upper surface of the stop vacuum chamber 136.

An arc formed by the hole portion 140 of the stop vacuum chamber 136 corresponds to the suction position D (see FIG. 1). If the pump 138 performs evacuation, the hole portion 140 of the stop vacuum chamber 136 is evacuated. If the hole portion 140 is evacuated, the tubes 128 disposed at positions that communicate with the hole portion 140 among the plural tubes 128 that pass through the inner wall of the rotating vacuum chamber 130 are evacuated. That is, the tubes 128 at the positions corresponding to the suction position D are evacuated.

If the tubes 128 at the positions that communicate with the hole portion 140 are evacuated, the long grooves 122 are evacuated through the valves 132 and the suction passages 124 provided corresponding to the tubes 128. In this way, the rotating vacuum chamber 130, the stop vacuum chamber 136, and the pump 138 function as a suction unit that evacuates the long grooves 122 at the suction position D among the plural long grooves 122.

Further, the valve 132 (an example of adjustment unit) is configured to adjust an air flow rate of the tube 128, to thereby adjust a suction flow rate of the long groove 122 which communicates through the tube 128 and the suction passage 124.

In such a configuration, as the pump 138 is operated to rotate the drum 110, an evacuation power acts on the long grooves 122 at the suction position D of the outer circumferential surface of the drum 110, and the sheet P transported on the outer circumferential surface of the drum 110 is suctioned and held onto the outer circumferential surface at the suction position D. Accordingly, the sheet transportation device 100 is able to suction and transport the sheet P at the suction position D.

Figure 3:
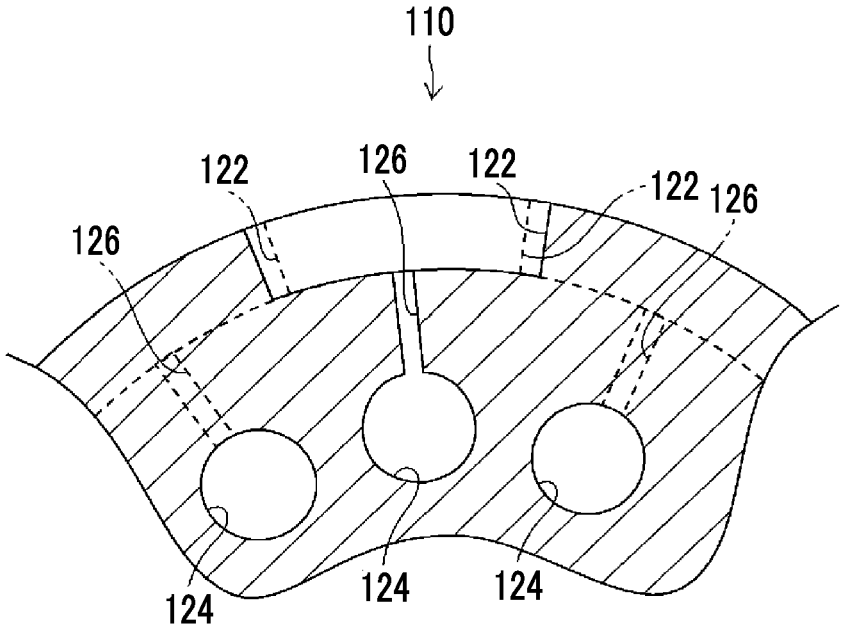
FIG. 3 is a sectional view of a drum 110 indicating a long groove 122, a suction passage 124, and a round hole 126.

The width and an outer diameter of the drum 110, the shape, the area and the number of the suction passage 124, an interval between adjacent suction passages 124, the shape, the area or the number of the long groove 122, an interval between adjacent long grooves 122, the number and arrangement of the grippers (grip unit) 114 are not limited to the examples shown in FIGS. 2 and 3, and may be appropriately set.

[Valve Opening and Closing Corresponding to Sheet Length]

Next, valve switching according to a circumferential length of the sheet P will be described.

Figure 4:
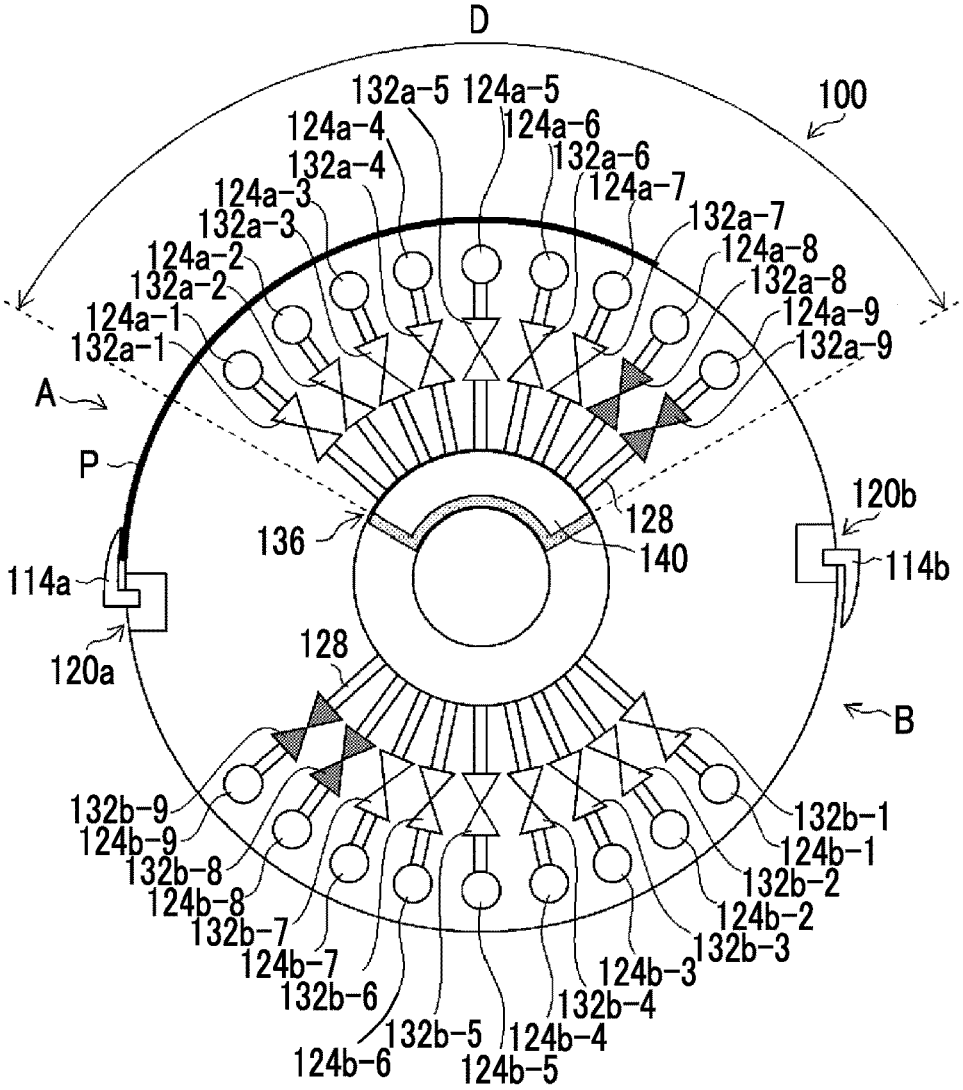
FIG. 4 is a diagram illustrating valve adjustment depending on a circumferential length of a sheet P.

In FIG. 4, the suction passages 124 arranged on a side of a surface (hereinafter, referred to as an A surface) where the sheet P of which a leading edge is gripped by the gripper (grip unit) 114*a* is held are expressed as suction passages 124*a*-1, 124*a*-2, 124*a*-3, . . . , 124*a*-8, and 124*a*-9, sequentially from a preceding side of the drum 110 in the rotating direction, and the valves 132 provided in the tubes 128 which communicate with the respective suction passages 124 are expressed as valves 132*a*-1, 132*a*-2, 132*a*-3, . . . , 132*a*-8, and 132*a*-9.

Similarly, the suction passages 124 arranged on a side of a surface (hereinafter, referred to as an B surface) where the sheet P of which a leading edge is gripped by the gripper (grip unit) 114*b* is held are expressed as suction passages 124*b*-1, 124*b*-2, 124*b*-3, . . . , 124*b*-8, and 124*b*-9, sequentially from the preceding side of the drum 110 in the rotating direction, and the valves 132 provided in the tubes 128 which communicate with the respective suction passages 124 are expressed as valves 132*b*-1, 132*b*-2, 132*b*-3, . . . , 132*b*-8, and 132*b*-9.

In the example shown in FIG. 4, a trailing edge of the sheet P held on the A surface of the drum 110 is disposed at a position corresponding to the suction passage 124*a*-7, and thus, the sheet P is not held at positions corresponding to the suction passages 124*a*-8 and 124*a*-9. That is, the sheet P is held at positions of the long grooves 122 which communicate with the suction passages 124*a*-1 to 124*a*-7 among the long grooves 122 arranged on the outer circumferential surface of the drum 110, and is not held at positions of the long grooves 122 which communicate with the suction passages 124*a*-8 and 124*a*-9.

Here, if the long grooves 122 at the positions where the sheet P is not held in the suction position are evacuated, air leakage occurs through these long grooves 122, and thus, the sheet P may not be appropriately suctioned and transported at the suction position D.

In order to prevent this problem, in the example shown in FIG. 4, on the A surface, the valves 132*a*-1 to 132*a*-7 are opened, and the valves 132*a*-8 and 132*a*-9 are closed. Thus, it is possible to perform evacuation only in the long grooves 122 which communicate with the suction passages 124*a*-1 to 124*a*-7, and to reliably suction and transport the sheet on the A surface. Further, on the B surface, the valves 132*b*-1 to 132*b*-7 are opened, and the valves 132*b*-8 and 132*b*-9 are closed. Thus, it is possible to perform evacuation only in the long grooves 122 which communicate with the suction passages 124*b*-1 to 124*b*-7, and to reliably suction and transport the sheet on the B surface.

A switching operation of each valve 132 may be automatically controlled by a control unit 156 (see FIG. 8), or may be manually performed before usage of the device is started, for example.

In a case where a sheet P having a length in a transportation direction different from that of the sheet P shown in FIG. 4 is transported, each valve 132 may be switched according to a trailing edge position of the sheet P so that only long grooves 122 in a necessary region are evacuated.

Here, a region on the outer circumferential surface of the drum 110 where the sheet P is held is referred to as a holding region. In the example shown in FIG. 4, a region from the gripper (grip unit) 114*a* to the position where the long groove 122 which communicates with suction passage 124*a*-7 is arranged, and a region from the gripper (grip unit) 114*b* to the position where the long groove 122 which communicates with the suction passage 124*b*-7 is arranged correspond to as the holding regions. In this way, the drum 110 has two holding regions, and holds the sheet P in each holding region. The control for opening and closing each valve 132 may be performed so that the long grooves 122 in the holding region are evacuated.

[Valve Adjustment Corresponding to Leading Edge Region]

Next, valve adjustment corresponding to a leading edge region will be described. Details thereof will be described later, but a region ranging from each of the grippers (grip unit) 114*a* and 114*b* to a position spaced therefrom by only a predetermined distance in the circumferential direction of the drum 110 is referred to as the leading edge region.

In FIGS. 5 and 6, a state where the valves 132*a*-1 to 132*a*-9 and 132*b*-1 to 132*b*-9 are opened is expressed as white, and a state where the valves 132*a*-1 to 132*a*-9 and 132*b*-1 to 132*b*-9 are closed is expressed as black. Further, a state where the suction passages 124*a*-1 to 124*a*-9 and 124*b*-1 to 124*b*-9 are evacuated, that is, a state where corresponding valves 132 are opened and corresponding long grooves 122 are disposed at the suction position D is expressed as white, and a state where the suction passages 124*a*-1 to 124*a*-9 and 124*b*-1 to 124*b*-9 are not evacuated is expressed as black.

Figure 5A:
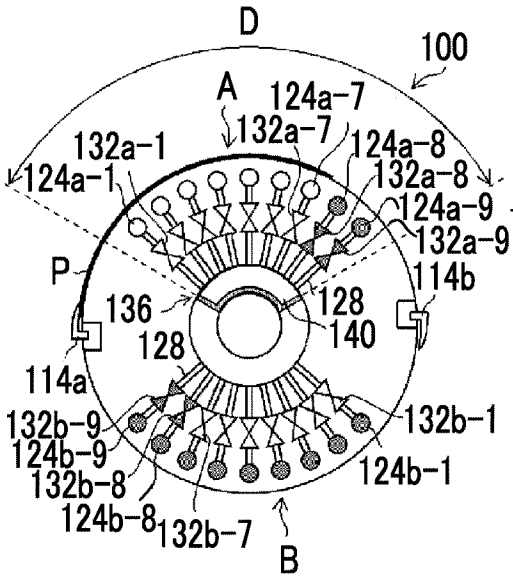
FIGS. 5A, 5B, and 5C are a diagram illustrating valve adjustment corresponding to a leading edge region.

FIG. 5A shows a state where a final sheet P in continuous transportation is held and transported on the A surface of the drum 110 in the sheet transportation device 100. Since the sheet P has the same circumferential length as that of the sheet P shown in FIG. 4, a holding region is the same as in the case shown in FIG. 4. That is, as shown in FIG. 5A, the valves 132*a*-1 to 132*a*-7 are opened, and the valves 132*a*-8 and 132*a*-9 are closed. Similarly, in the case of the B surface, the valves 132*b*-1 to 132*b*-7 are opened, and the valves 132*b*-8 and 132*b*-9 are closed. Further, the state shown in FIG. 5A represents that the long grooves 122 (see FIG. 2) in the holding region of the A surface are all disposed at the suction position D and the suction passages 124*a*-1 to 124*a*-7 are evacuated.

Figure 5B:
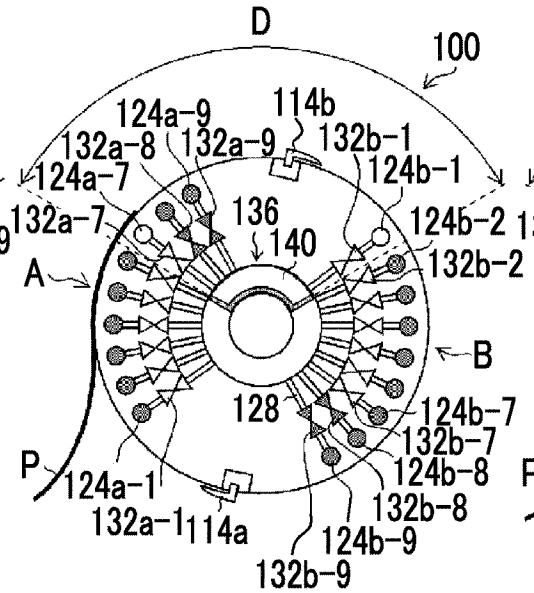

FIG. 5B shows a state where the transportation of the sheet P is performed from the state shown in FIG. 5A and the long groove 122 which communicates with the suction passage 124*b*-1 reaches the suction position D. That is, the tube 128 which communicates with the suction passage 124*b*-1 reaches the hole portion 140 of the stop vacuum chamber 136, and the long groove 122 is evacuated through the suction passages 124*b*-1 by the stop vacuum chamber 136.

Figure 5C:
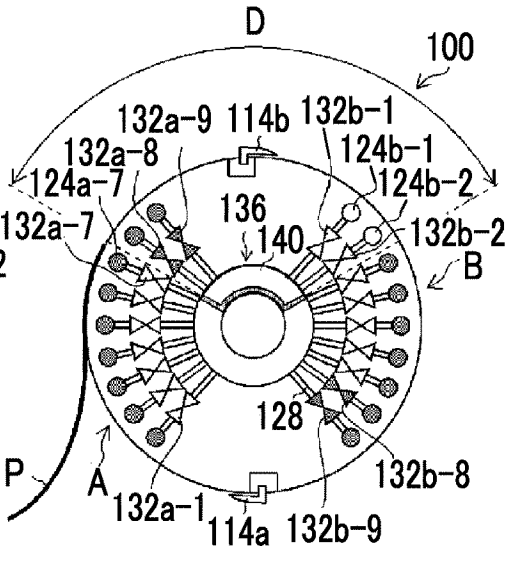

Further, FIG. 5C shows a state where the transportation of the sheet P is performed from the state shown in FIG. 5B and a trailing edge of the final sheet P passes through the suction position D.

In a case where the sheet P on the A surface is not the final sheet, since the sheet P is also transported on the B surface, if the long groove 122 which communicates with the suction passage 124*b*-1 reaches the suction position D, the long groove 122 suctions the sheet P on the B surface.

However, in the state shown in FIG. 5B, since the sheet P is not transported on the B surface, the long groove 122 which communicates with the suction passage 124*b*-1 is opened. Accordingly, even though the pump 138 (see FIG. 2) performs evacuation, air leaks from the long groove 122 which communicates with the suction passage 124*b*-1. As a result, a suction pressure at the trailing edge of the final sheet P is rapidly decreased, and when the stiffness of the sheet P is high, there is a problem in that the suction of the final sheet P may not be appropriately performed at the position of the long groove 122 which communicates with the suction passage 124*a*-7 and the trailing edge of the final sheet P is separated. Particularly, this problem is noticeable in a case where the thickness of the sheet is equal to or greater than 0.2 [mm].

In order to solve such a problem, it is necessary to set the suction flow rate of the long groove 122 which communicates with the suction passage 124*b*-1 to be smaller than each suction flow rate of the long grooves 122 which communicate with the suction passages 124*b*-2 to 124*b*-7. By setting the suction flow rate in this way, even in a case where the long groove 122 which communicates with the suction passage 124*b*-1 is opened, it is possible to reduce the amount of air that leaks from the long groove 122, to delay the decrease in the suction pressure. Thus, it is possible to prevent separation of the trailing edge of the final sheet P.

On the other hand, when suctioning and holding a thin sheet P, in order to suction the sheet P without wrinkle, it is necessary to set the suction flow rate to be smaller than that in a case where a thick sheet P is suctioned and held.

However, if the suction flow rate of the long groove 122 which communicates with the suction passage 124*b*-1 is set to be smaller than each suction flow rate of the long grooves 122 which communicate with the suction passages 124*b*-2 to 124*b*-7, in a case where an air permeability of the sheet P is high, the suction flow rate of the sheet P in the leading edge region in the long groove 122 which communicates with the suction passage 124*b*-1 excessively becomes small, and thus, increase in the suction pressure is delayed, which causes a problem in that the leading edge of the sheet P may not be appropriately suctioned and sheet lifting may occur.

In order to solve such a problem, in a case where the thickness of the sheet P is equal to or greater than 0.20 [mm] (an example of a first threshold value), the sheet transportation device 100 determines that the sheet P is a high stiffness sheet, and sets a suction flow rate of the long groove 122 arranged in a subsequent region other than the leading edge region in the holding region as a first suction flow rate, a suction flow rate of the long groove 122 arranged in the leading edge region as a second suction flow rate which is smaller than the first suction flow rate, to thereby prevent separation of the trailing edge of the sheet P.

In the example shown in FIG. 5, a region where each long groove 122 which communicates with the suction passages 124*a*-1 and 124*b*-1 in the holding region is evacuated corresponds to the leading edge region. That is, the leading edge region is a region of a subsequent sheet P disposed at the suction position D when a trailing edge of a preceding sheet P which is being transported completely passes through the suction position D.

Here, it is preferable that the second suction flow rate is equal to or greater than ⅙ and is equal to or smaller than ½ of the first suction flow rate.

On the other hand, in a case where the thickness of the sheet P is smaller than 0.20 [mm], it is determined that the sheet is not a high stiffness sheet, and each suction flow rate of the entire long grooves 122 in the holding region is set as a third suction flow rate which is smaller than the first suction flow rate, to thereby reliably adsorb the entire region including the leading edge region. The third suction flow rate may be the same suction flow rate as the second suction flow rate.

Particularly, in a case where the thickness of the sheet P is smaller than 0.15 [mm] (an example of a second threshold value), it is determined that the sheet P is a high air permeability sheet, and each suction flow rate of the entire long grooves 122 in the holding region is set as a fourth suction flow rate which is smaller than the second suction flow rate and the third suction flow rate, to thereby reliably adsorb the entire region including the leading edge region of the sheet P without wrinkle.

In the example shown in FIG. 5, in a case where the thickness of the sheet P is equal to or greater than the first threshold value, the valves 132*b*-2 to 132*b*-7 are adjusted to set each suction flow rate of the long grooves 122 which communicate with the suction passages 124*b*-2 to 124*b*-7 as the first suction flow rate. Further, the valve 132*b*-1 is adjusted to set the suction flow rate of the long groove 122 which communicates with the suction passage 124*b*-1 as the second suction flow rate. Here, a relationship of the first suction flow rate>the second suction flow rate is established.

Further, in a case where the thickness of the sheet P is smaller than the first threshold value, the valves 132*b*-1 to 132*b*-7 are adjusted to set each suction flow rate of the long grooves 122 which communicate with the suction passages 124*b*-1 to 124*b*-7 as the third suction flow rate. Here, a relationship of the first suction flow rate>the third suction flow rate is established.

Further, the valves 132*a*-1 to 132*a*-7 are adjusted in a similar way so that any one of the A surface and the B surface of the drum 110 can transport a final sheet.

The thickness of the sheet P may be acquired through user's input, or may be acquired through measurement using a sensor. Further, the adjustment of the suction flow rate of the long groove 122 using each valve 132 may be automatically controlled in the control unit 156 (see FIG. 8), or may be manually performed when starting up the device, for example.

In the example shown in FIG. 5, the leading edge region of the sheet P includes a region where each long groove 122 which communicates with the suction passages 124*a*-1 and 124*b*-1 in the holding region is evacuated, but which long groove 122 is included in the leading edge region is relevant to the circumferential length of the sheet P.

Figure 6A:
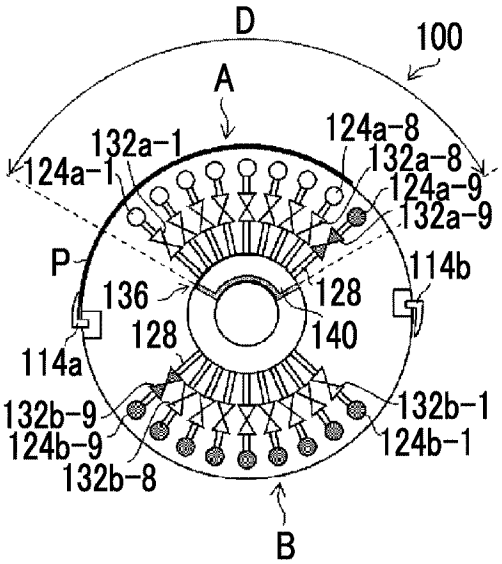
FIGS. 6A, 6B, and 6C are a diagram illustrating valve adjustment corresponding to the leading edge region.

FIG. 6A shows a state where a final sheet P in continuous transportation is held and transported on the A surface of the drum 110 in the sheet transportation device 100, in which a sheet P having a circumferential length longer than that of the sheet P shown in FIG. 5A is transported. In this example, since a trailing edge of the sheet P is disposed at the position of the suction passage 124*a*-8, the valves 132*a*-1 to 132*a*-8 are opened, and the valve 132*a*-9 is closed. Similarly, in the case of the B surface, the valves 132*b*-1 to 132*b*-8 are opened, and the valve 132*b*-9 is closed. That is, a region ranging from the gripper (grip unit) 114*a* to the long groove 122 (see FIG. 2) which communicates with the suction passage 124*a*-8 and a region ranging from the gripper (grip unit) 114*b* to the long groove 122 which communicates with the suction passage 124*b*-8 correspond to the holding regions.

Figure 6B:
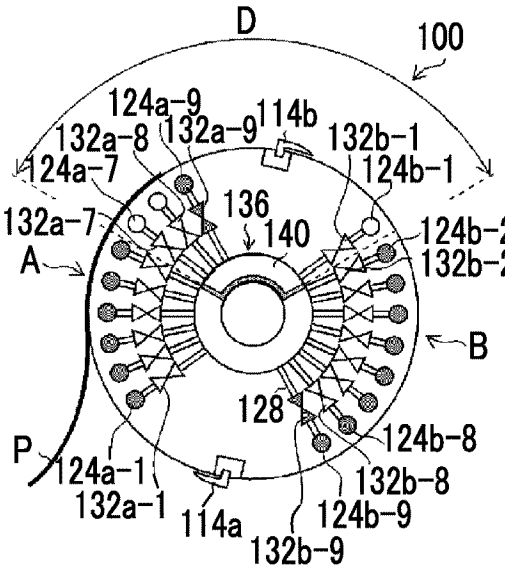

FIG. 6B shows a state where the transportation of the sheet P is performed from the state shown in FIG. 6A and the long groove 122 which communicates with the suction passage 124*b*-1 reaches the suction position D. That is, the tube 128 which communicates with the suction passage 124*b*-1 reaches the hole portion 140 of the stop vacuum chamber 136, and the long groove 122 is evacuated through the suction passages 124*b*-1 by the stop vacuum chamber 136.

In the state shown in FIG. 6B, similar to the state shown in FIG. 5B, since the sheet P is not transported on the B surface, the long groove 122 which communicates with the suction passage 124*b*-1 is opened. Accordingly, even though the pump 138 (see FIG. 2) performs evacuation, air leaks from the long groove 122 which communicates with the suction passage 124*b*-1. As a result, when the stiffness of the sheet P is high, the final sheet P may not be appropriately suctioned in the long groove 122 which communicates with the suction passages 124*a*-7 and 124*a*-8.

Figure 6C:
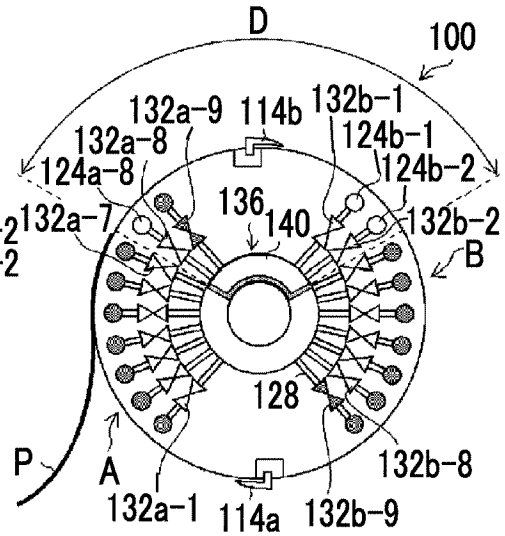

FIG. 6C shows a state where the transportation of the sheet P is performed from the state shown in FIG. 6B and the long groove 122 which communicates with the suction passage 124*b*-2 reaches the suction position D. That is, the tubes 128 which communicate with the suction passage 124*b*-1 and the suction passage 124*b*-2 reach the hole portion 140 of the stop vacuum chamber 136, and the long grooves 122 are evacuated through the suction passage 124*b*-1 and the suction passage 124*b*-2 by the stop vacuum chamber 136.

In the case shown in FIG. 6C, similarly, since the long grooves 122 which communicate with the suction passages 124*b*-1 and 124*b*-2 are opened, even though the pump 138 performs evacuation, air leaks from the long grooves 122 which communicate with the suction passage 124*b*-1 and 124*b*-2. That is, in this case, the leading edge region is a region including a region where the long grooves 122 which communicate with the suction passages 124*b*-1 and 124*b*-2 in the holding region are arranged.

Accordingly, in a case where the sheet P is a high stiffness sheet, it is necessary to set each suction flow rate of the long grooves 122 which communicate with the suction passages 124*b*-1 and 124*b*-2 in the holding region to be smaller than each suction flow rate of the long grooves 122 which communicate with the suction passages 124*b*-3 to 124*b*-8.

In this case, the valves 132*b*-3 to 132*b*-8 are adjusted so that each suction flow rate of the long grooves 122 which communicate with the suction passages 124*b*-3 to 124*b*-8 is set as the first suction flow rate and the valves 132*b*-1 and 132*b*-2 are adjusted so that each suction flow rate of the long grooves 122 which communicate with the suction passages 124*b*-1 and 124*b*-2 is set as the second suction flow rate. Here, a relationship of the first suction flow rate>the second suction flow rate is established.

In the case of the A surface, the valves 132*a*-1 to 132*a*-8 are adjusted in a similar way so that the suction flow rates are set.

By setting the suction flow rates in this way, even in a case where the long grooves 122 which communicate with the suction passages 124*b*-1 and 124*b*-2 are opened, it is possible to reduce the amount of air that leaks from the long groove 122, and thus, it is possible to prevent separation of the trailing edge of the final sheet P.

[Calculation of Leading Edge Region]

A leading edge region calculation method will be described.

Figure 7A:
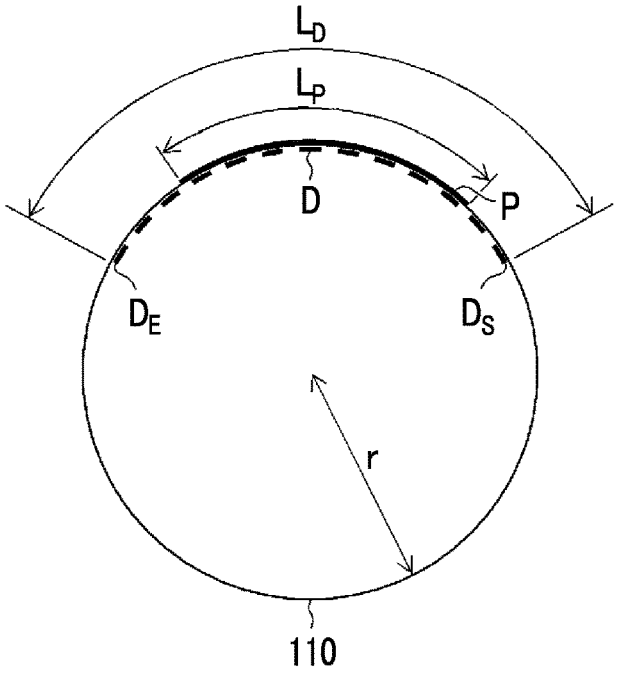
FIGS. 7A and 7B is a diagram illustrating definition of the leading edge region.
Figure 7B:
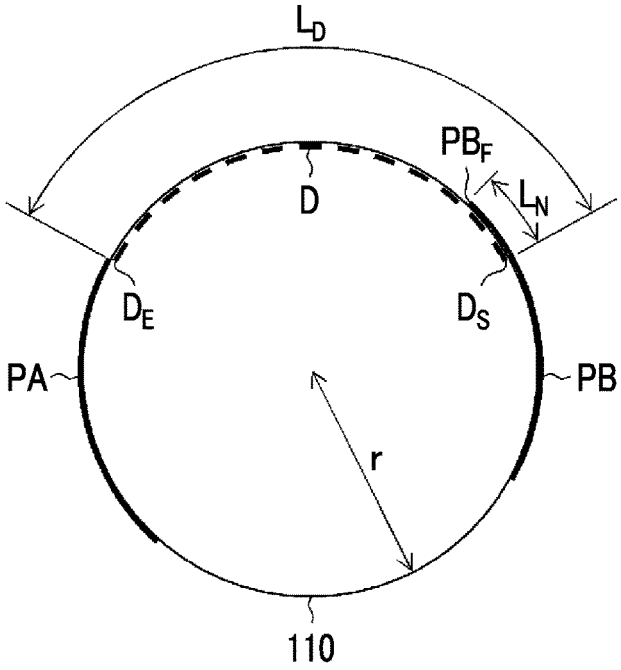

As shown in FIG. 7, the radius of the drum 110 is represented as "r", the length, in the circumferential direction of the drum 110, of the sheet P held by the drum 110 is represented as $L_F$. Further, a suction starting position of the suction position D seen from the transported sheet P is represented as $D_S$, a suction ending position is represented as $D_E$, and the length of the suction position D in the circumferential direction of the drum 110 (a distance from the suction starting position $D_S$ to the suction ending position $D_E$) is represented as $L_D$.

Here, the drum 110 is configured to be able to transport two sheets P at one time on the A surface and the B surface, in which the sheet P transported on the A surface is represented as a sheet PA and a trailing edge of the sheet PA is represented as $PA_R$, and the sheet transported on the B surface is represented as a sheet PB and a leading edge of the sheet PB is represented as $PB_F$.

As described hereinbefore, the leading edge region is a region ranging from the position of the leading edge $PB_F$ of the sheet PB to the suction starting position $D_S$ when the trailing edge $PA_R$ of the sheet PA passes through the suction ending position $D_E$. A circumferential distance $L_N$ between the position of the leading edge $PB_F$ of the sheet PB and the suction starting position $D_S$ is equal to a circumferential distance between the position of the trailing edge $PA_R$ of the sheet PA and the suction ending position $D_E$ when the leading edge $PB_F$ of the sheet PB passes through the suction starting position $D_S$, which may be expressed as follows.

$$L_N=L_D+L_P-\pi r \quad \text{(Expression 1)}$$

In this way, the leading edge region is a region ranging from a preceding end portion according to rotation of the drum 110 in the holding region to a position spaced by the distance $L_N$ along the circumferential direction of the drum 110 toward a trailing edge.

For example, in the example shown in FIG. 4, the region ranging from the gripper (grip unit) 114*a* to the distance $L_N$ along the circumferential direction of the drum 110 becomes the leading edge region. Accordingly, in a case where the thickness of the sheet P is equal to or greater than the first threshold value, the suction flow rate of the long groove 122 may be set as the second suction flow rate by the valve 132 of the tube 128 which communicates with the long groove 122 included in the leading edge region, and the suction flow rate of the long groove 122 may be set as the first suction flow rate by the valve 132 of the tube 128 which communicates with the long groove 122 included in a subsequent region other than the leading edge region in the holding region.

Here, in a case where n (n is an integer of 1 or more) holding regions are provided on the drum 110 and n sheets P are able to be held at one time (that is, n corresponds to the number of holding regions), the distance $L_N$ for calculating each leading edge region may be expressed as follows.

$$L_N=L_D+L_P-2\pi/n \quad \text{(Expression 2)}$$

That is, the leading edge region of each holding region in this case is a region ranging from a preceding end portion according to rotation of the drum 110 in each holding region to a position spaced by the distance $L_N$ of Expression 2 along the circumferential direction of the drum 110 toward a trailing edge.

[Electric Configuration of Recording Medium Transportation Device]

Figure 8:
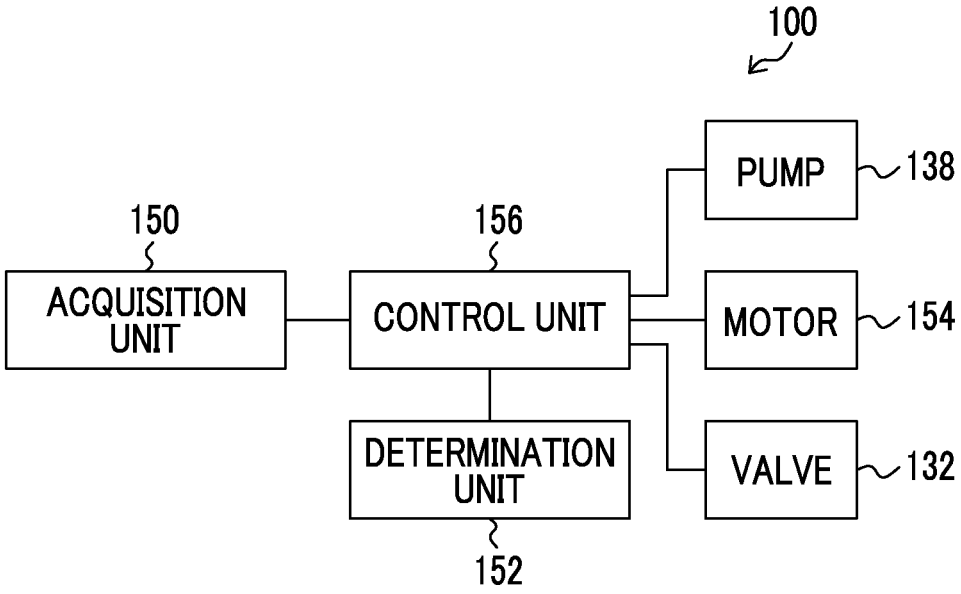
FIG. 8 is a block diagram illustrating an electrical configuration of the sheet transportation device 100.

An electric configuration of the sheet transportation device 100 for performing the valve adjustment will be described. As shown in FIG. 8, the sheet transportation device 100 comprises an acquisition unit 150, a determination unit 152, a motor 154, a control unit 156, and the like.

The acquisition unit 150 (an example of acquisition unit) is an input interface that acquires sheet information about the length and the thickness of the sheet P to be transported in the sheet transportation device 100. The acquisition unit 150 may be an input unit for user's input of sheet information through a touch panel or a keyboard, or may be a measurement unit for acquiring sheet information by a sensor.

The determination unit 152 (an example of determination unit) comprises a memory that stores a first threshold value (for example, 0.20 [mm]) or a second threshold value (for example, 0.15 [mm]), and determines whether the thickness of the sheet P is equal to or greater than the first threshold value and whether the thickness of the sheet P is equal to or greater than the second threshold value, on the basis of the sheet information acquired by the acquisition unit 150.

The motor 154 is an electric power unit connected to the rotating shaft 112, and the drum 110 rotates according to rotation of the motor 154.

The control unit 156 (an example of determination unit) is a control unit for generally controlling an operation of the sheet transportation device 100. The control unit 156 controls the motor 154 to rotate the drum 110, and controls the pump 138 to generate an evacuation power for the long grooves 122. Further, the control unit 156 comprises a memory that stores first to fourth suction flow rates, and controls the valve 132 to adjust a suction flow rate of each long groove 122.

[Transportation Method of Recording Medium Transportation Device]

Figure 9:
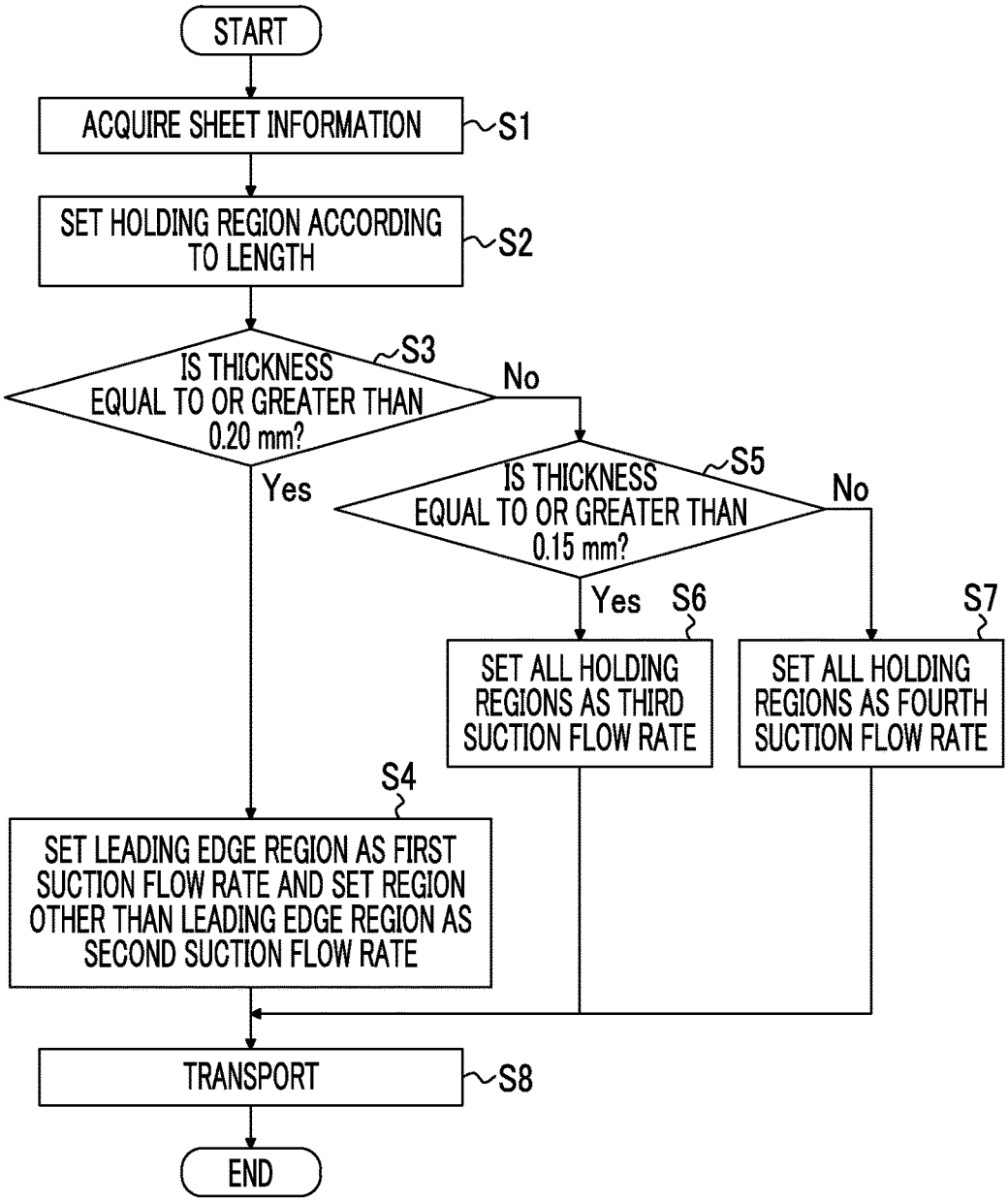
FIG. 9 is a flowchart illustrating a transportation method of a sheet P using the sheet transportation device 100.

Next, a transportation method (an example of a recording medium transportation method) of the sheet P in the sheet transportation device 100 will be described with reference to FIG. 9.

(Step S1: Acquisition Process)

First, in step S1, sheet information about the length and the thickness of the sheet P transported by the acquisition unit 150 is acquired. The sheet information may be input by a user, or may be measured by a sensor.

(Step S2: Holding Region Setting Process)

Next, in step S2, a holding region is set according to the length of the sheet P acquired by the control unit 156, and switching of the valves 132 is performed. That is, the respective valves 132*a*-1 to 132*a*-9 and 132*b*-1 to 132*b*-9 are opened and closed so that a position where a trailing edge of the sheet P when a leading edge of the sheet P is gripped by each of the grippers (grip unit) 114*a* and 114*b* arrives from the length of the acquired sheet P is calculated, long grooves 122 arranged from the leading edge of the sheet P to the trailing edge thereof are evacuated, and long grooves 122 arranged on a subsequent side of the drum 110 in the rotating direction with reference to the trailing edge are not evacuated.

In the case of the example shown in FIG. 5, the valves 132*a*-1 to 132*a*-7 and 132*b*-1 to 132*b*-7 are opened, and the valves 132*a*-8, 132*a*-9, 132*b*-8 and 132*b*-9 are closed.

(Step S3: First Determination Process)

Next, in step S3, the determination unit 152 determines whether the acquired thickness of the sheet P is equal to or greater than the first threshold value, that is, equal to or greater than 0.20 [mm].

In a case where the thickness of the sheet P is equal to or greater than 0.20 [mm], it is determined that the sheet P is thick and is a high stiffness sheet, and then, the procedure proceeds to step S4. Further, in a case where the thickness of the sheet P is smaller than 0.20 [mm], it is determined that the sheet P is not a high stiffness sheet, and then, the procedure proceeds to step S5.

[Step S4: First Setting Process]

In step S4, the control unit 156 adjusts, so that each suction flow rate of the long grooves 122 in the subsequent region other than the leading edge region in the holding regions is set as the first suction flow rate and each suction flow rate of the long grooves 122 in the leading edge region is set as the second suction flow rate which is smaller than the first suction flow rate, the valves 132 corresponding to each region. The leading edge region may be calculated using Expression 1 or Expression 2.

In the case of the example shown in FIG. 5, the control unit 156 adjusts, so that each suction flow rate of the long grooves 122 corresponding to the subsequent region other than the leading edge region among the long grooves 122 corresponding to the holding regions is set as the first suction flow rate, the valves 132*a*-2 to 132*a*-7 and 132*b*-2 to 132*b*-7 provided corresponding to the suction passages 124*a*-2 to 124*a*-7 and 124*b*-2 to 124*b*-7 which communicate with the long grooves 122. Further, the control unit 156 adjusts, so that each suction flow rate of the long grooves 122 corresponding to the leading edge region is set as the second suction flow rate, the valves 132*a*-1 and 132*b*-1 provided corresponding to the suction passages 124*a*-1 and 124*b*-1 which communicate with the long grooves 122.

(Step S5: Second Determination Process)

Next, in step S5, the determination unit 152 determines whether the acquired thickness of the sheet P is equal to or greater than the second threshold value, that is, equal to or greater than 0.15 [mm].

In a case where the thickness of the sheet P is equal to or greater than 0.15 [mm], it is determined that the sheet P is not a high air permeability sheet, and then, the procedure proceeds to step S6. Further, in a case where the thickness of the sheet P is smaller than 0.15 [mm], it is determined that the sheet is a high air permeability sheet, and then, the procedure proceeds to step S7.

[Step S6: Second Setting Process]

In step S6, the control unit 156 adjusts, so that each suction flow rate of the long grooves 122 in the holding regions is set as the third suction flow rate, the valves 132 corresponding to each region.

In the case of the example shown in FIG. 5, the control unit 156 adjusts, so that each suction flow rate of the long grooves 122 corresponding to the holding regions is set as the third suction flow rate which is lower than the first suction flow rate, the valves 132*a*-1 to 132*a*-7 and 132*b*-1 to 132*b*-7 provided corresponding to the suction passages 124*a*-1 to 124*a*-7 and 124*b*-1 to 124*b*-7 which communicate with the long grooves 122.

(Step S7: Third Setting Process)

In step S7, the control unit 156 adjusts, so that each suction flow rate of the long grooves 122 in the holding regions is set as the fourth suction flow rate which is smaller than the second suction flow rate and the third suction flow rate, the valves 132 corresponding to each region.

In the case of the example shown in FIG. 5, the control unit 156 adjusts, so that each suction flow rate of the long grooves 122 corresponding to the holding regions is set as the fourth suction flow rate, the valves 132*a*-1 to 132*a*-7 and 132*b*-1 to 132*b*-7 provided corresponding to the suction passages 124*a*-1 to 124*a*-7 and 124*b*-1 to 124*b*-7 which communicate with the long grooves 122.

(Step S8: Transportation Process)

In step S8, the control unit 156 controls the motor 154 to rotate the drum 110, and controls the pump 138 to evacuate the stop vacuum chamber 136. Thus, the sheet P held on the drum 110 is transported by rotation of the drum 110. Here, the long grooves 122 at the suction position D among the plural long grooves 122 are evacuated by the pump 138, through the stop vacuum chamber 136 and the rotating vacuum chamber 130. Accordingly, if the holding region reaches the suction position D, the sheet P held on the outer circumferential surface of the drum 110 is suctioned and held on the outer circumferential surface of the drum by the long groove 122.

Through the above-described processes, it is possible to set a holding region according to the length of the sheet P, and to set an suction flow rate depending on the thickness of the sheet P, to thereby appropriately suction and transport the sheet P.

Second Embodiment

[Overall Configuration of Inkjet Recording Device]

Figure 10:
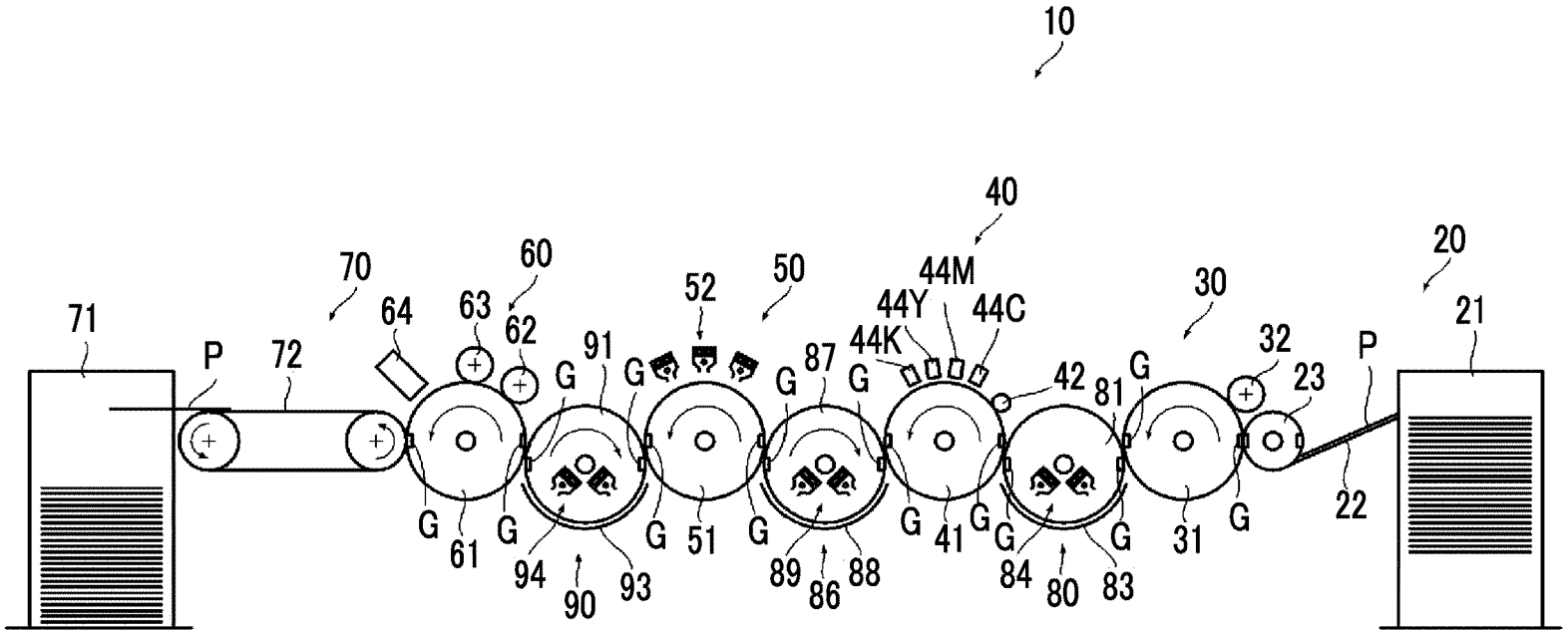
FIG. 10 is a schematic view illustrating an entire configuration of an inkjet recording device 10.

FIG. 10 is a schematic diagram illustrating an overall configuration of an inkjet recording device according to the second embodiment. An inkjet recording device 10 shown in FIG. 10 (an example of an image forming apparatus) is a recording device that performs recording by an inkjet method using aqueous ink (ink containing water in a solvent) on each sheet P, and comprises a sheet feed unit 20 that feeds the sheet P, a process liquid applying unit 30 that applies a process liquid to a recording surface of the sheet P, an image recording unit 40 that jets ink droplets of respective colors of cyan (C), magenta (M), yellow (Y), and black (K) using inkjet heads onto the recording surface of the sheet P to draw a color image, an ink dryer unit 50 that dries the ink droplets jetted on the sheet P, a fixing unit 60 that fixes an image recorded on the sheet P, and a collection unit 70 that collects the sheet P.

As an unit for transporting each sheet P, transportation drums 31, 41, 51, and 61 are provided in respective units of the process liquid applying unit 30, the image recording unit 40, the ink dryer unit 50, and the fixing unit 60. The sheet P is transported to the respective units of the process liquid applying unit 30, the image recording unit 40, the ink dryer unit 50, and the fixing unit 60 by the transportation drums 31, 41, 51, and 61.

Here, as the transportation drums 31, 41, 51, and 61, the sheet transportation device 100 shown in FIG. 2 is used. Each of the transportation drums 31, 41, 51, and 61 is formed corresponding to a sheet width, and is driven and rotated by a motor (not shown) (FIG. 10 shows rotation in a counterclockwise direction). On the outer circumferential surface of each of the transportation drums 31, 41, 51, and 61, a gripper (grip unit) G (corresponding to the grippers (grip unit) 114*a* and 114*b*) is provided, and a leading edge portion of the sheet P is gripped by the gripper (grip unit) G for transportation. In this example, the gripper (grip unit) G is provided in two portions (at an interval of 180°) on the outer circumferential surface of each of the transportation drums 31, 41, 51, and 61, and two sheets are able to be transported in one revolution. Further, multiple suction holes (not shown, corresponding to the long grooves 122) are formed on the outer circumferential surface of each of the transportation drums 31, 41, 51, and 61, and a rear surface of the sheet P is vacuum-suctioned through the suction holes at the suction position D (see FIG. 1), and thus, the sheet P is held on the outer circumferential surface of each of the transportation drums 31, 41, 51, and 61.

Between the process liquid applying unit 30 and the image recording unit 40, between the image recording unit 40 and the ink dryer unit 50, and between the ink dryer unit 50 and the fixing unit 60, transfer barrels 80, 86, and 90 are respectively arranged. The sheet P is transported between the respective units by the transfer barrels 80, 86, and 90.

Each of the transfer barrels 80, 86, and 90 is configured by each of transfer barrel bodies 81, 87, and 91 formed by frames, and the gripper (grip unit) G provided in each of the transfer barrel bodies 81, 87, and 91. The transfer barrels bodies 81, 87, and 91 are formed corresponding to a sheet width, and are driven and rotated by a motor (not shown) (FIG. 10 shows rotation in a clockwise direction). Thus, the grippers (grip unit) G are rotated on the same circumferential surface. The sheet P is transported with a leading edge portion being gripped by the gripper (grip unit) G. In this example, a pair of grippers (grip unit) G is arranged in symmetric positions with the rotating shaft being interposed therebetween, and is configured to hold and transport two sheets of the A surface and the B surface in one revolution (one cycle).

Under the transfer barrels 80, 86, and 90, arc-shaped guide plates 83, 88, and 93 are provided along a transport path of the sheet P. The sheet P transported by the transfer barrels 80, 86, and 90 is transported to the guide plates 83, 88, and 93 with a rear surface (surface opposite to a recording surface) thereof being guided.

Further, dryers 84, 89, and 94 that blows hot air toward the sheet P transported by the transfer barrel 80 are arranged inside the transfer barrels 80, 86, and 90. The hot air blown from the dryers 84, 89, and 94 is applied to the recording surface of the sheet P transported by the transfer barrels 80, 86, and 90.

The sheet P fed from the sheet feed unit 20 is transferred to the transportation drum 31 of the process liquid applying unit 30, and is then transferred to the transportation drum 41 of the image recording unit 40 from the transportation drum 31 of the process liquid applying unit 30 through the transfer barrel 80. Then, the sheet P is transferred to the transportation drum 51 of the ink dryer unit 50 from the transportation drum 41 of the image recording unit 40 through the transfer barrel 86, and is then transferred to the transportation drum 61 of the fixing unit 60 from the transportation drum 51 of the ink dryer unit 50 through the transfer barrel 90. Then, the sheet P is transferred to the collection unit 70 from the transportation drum 61 of the fixing unit 60. The sheet P is subject to necessary processes in the series of transport processes, so that an image is formed on the recording surface thereof.

The sheet P is transported to the transportation drums 31, 41, 51, and 61 with the recording surface being directed outwardly, and is transported to the transfer barrels 80, 86, and 90 with the recording surface being directed inwardly.

[Configurations of Respective Units of Inkjet Recording Device]

Hereinafter, configurations of the respective units of the inkjet recording device 10 according to this embodiment will be described.

(Sheet Feed Unit)

The sheet feed unit 20 comprises a sheet feeder 21, a sheet feed tray 22, and a transfer barrel 23, and continuously feeds each sheet P to the process liquid applying unit 30 one by one.

The sheet feeder 21 feeds the sheets P stacked in a magazine (not shown) to the sheet feed tray 22 one by one in a sequential manner from the top. The sheet feed tray 22 sends the sheet P fed from the sheet feeder 21 to the transfer barrel 23. The transfer barrel 23 receives the sheet P sent from the sheet feed tray 22, transports the sheet P along the transport path, and transfers the sheet P to the transportation drum 31 of the process liquid applying unit 30.

A general-purpose recording sheet (recording medium) which is not an inkjet exclusive sheet may be used as the sheet P.

(Process Liquid Applying Unit)

The process liquid applying unit 30 applies a process liquid to the recording surface of the sheet P. The process liquid applying unit 30 comprises the transportation drum 31 that transports the sheet P, and a process liquid applier 32 that applies the process liquid to the recording surface of the sheet P transported by the transportation drum 31.

The transportation drum 31 receives the sheet P from the transfer barrel 23 of the sheet feed unit 20 (grips and receives the leading edge of the sheet P using the gripper (grip unit) G), and rotates the sheet P for transportation.

The process liquid applier 32 applies a process liquid having a function of aggregating color materials in ink to the recording surface of the sheet P transported by the transportation drum 31. The process liquid applier 32 is configured by a coater that performs coating of the process liquid using a roller, for example, in which a coating roller of which an outer circumferential surface is given the process liquid is pressed against and comes in contact with the surface of the sheet P so that the process liquid is applied to the recording surface of the sheet P. By giving such a process liquid in advance to jet the ink, even in a case where a general-purposes recording sheet is used, it is possible to prevent feathering, bleeding, or the like, to thereby perform high-quality recording. As the process liquid applier 32, a configuration in which the process liquid is applied using a droplet discharge head which is the same as an inkjet head (which will be described later) or a configuration in which the process liquid is applied using a spray may be used, for example.

According to the process liquid applying unit 30 configured as described above, the sheet P is transported by the transportation drum 31, and the process liquid is applied to the recording surface from the process liquid applier 32 in the transport process. Then, the sheet P of which the recording surface is given the process liquid is transferred to the transfer barrel 80 from the transportation drum 31.

Here, as described above, the dryer 84 is provided in the transfer barrel 80, and hot air is blown toward the guide plate 83. In the process where the sheet P is transported to the image recording unit 40 from the process liquid applying unit 30 by the transfer barrel 80, the hot air is applied to the recording surface of the sheet P, so that the process liquid applied to the recording surface is dried (a solvent component in the process liquid is evaporated and removed).

(Imaging Recording Unit)

The image recording unit 40 (an example of recording unit) jets ink droplets of respective colors of C, M, Y, and K onto the recording surface of the sheet P to draw a color image on the recording surface of the sheet P. The image recording unit 40 comprises the transportation drum 41 that transports the sheet P, a sheet pressing roller 42 that presses the recording surface of the sheet P transported by the transportation drum 41 and brings the rear surface of the sheet P in close contact with the outer circumferential surface of the transportation drum 41, and inkjet heads 44C, 44M, 44Y, and 44K that discharge ink droplets of the respective colors of C, M, Y, and K onto the sheet P.

The transportation drum 41 receives the sheet P from the transfer barrel 80, and transports the sheet P while being rotated. Here, as described above, the sheet P is transported in a state of being suctioned and held on the outer circumferential surface of the transportation drum 41. Accordingly, when an arc-shaped surface (a region from a position where the sheet P is received from the transfer barrel 80 to a position where the sheet P is transferred to the transfer barrel 86) regulated by the outer circumferential surface of the transportation drum 41 is represented as a transport surface, the sheet P is transported through a transport path set on the transport surface. The transport path passes though the center of the transportation drum 41, and is set corresponding to the width of the sheet P.

The sheet pressing roller 42 is provided in the vicinity of a sheet reception position (the position where the sheet P is received from the transfer barrel 80) of the transportation drum 41, and a pressing force is applied thereto by a pressing mechanism (not shown), so that the sheet pressing roller 42 is pressed against and comes in contact with the outer circumferential surface of the transportation drum 41. The sheet P transferred to the transportation drum 41 from the transfer barrel 80 is nipped while passing through the sheet pressing roller 42, and the rear surface thereof comes in close contact with the outer circumferential surface of the transportation drum 41.

Four inkjet heads 44C, 44M, 44Y, and 44K are arranged to face the suction position D of the transportation drum 41 along the transport path of the sheet P. Each of the inkjet heads 44C, 44M, 44Y, and 44K is configured by a line head corresponding to the sheet width, and ink droplets of corresponding color are discharged toward the transportation drum 41 from a nozzle array formed on a nozzle surface thereof.

According to the image recording unit 40 having the above-described configuration, the sheet P is transported by the transportation drum 41. The sheet P transferred to the transportation drum 41 from the transfer barrel 80 is first nipped by the sheet pressing roller 42 to be in close contact with the outer circumferential surface of the transportation drum 41. Then, if the sheet P reaches the suction position D, the sheet P is suctioned by suction holes. Further, ink droplets of the respective colors of C, M, Y, and K are jetted onto the recording surface from the respective inkjet heads 44C, 44M, 44Y, and 44K which are arranged at the suction position D, so that a color image is drawn on the recording surface of the sheet P.

In the inkjet recording device 10, particularly, it is important to apply the sheet transfer device 100 to the transportation drum 41. By applying the sheet transportation device 100 to the transportation drum 41, it is possible to prevent separation, lifting or wrinkles of the sheet P in the image recording unit 40. Thus, it is possible to prevent shock between the inkjet heads 44C, 44M, 44Y, and 44K and the sheet P, to thereby prevent damage of the inkjet heads 44C, 44M, 44Y, and 44K.

Here, in the inkjet recording device 10 of this example, an aqueous ink in which thermoplastic resin is spread in ink for each color is used. Even in a case where such an aqueous ink is used, since the process liquid is applied to the sheet P as described above, it is possible to perform high-quality recording without causing feathering, bleeding, or the like.

The sheet P on which an image is drawn is transferred to the transfer barrel 86, is transported by the transfer barrel 86, and is transferred to the transportation drum 51 of the ink dryer unit 50. As described above, the dryer 89 is provided in the transfer barrel 86, and hot air is blown toward the guide plate 88. The ink drying process is performed in the ink dryer unit 50 in a subsequent stage, but the sheet P undergoes the drying process even in transportation using the transfer barrel 86.

Although not shown, a maintenance unit that performs maintenance of the inkjet heads 44C, 44M, 44Y, and 44K is provided in the image recording unit 40. The inkjet heads 44C, 44M, 44Y, and 44K are configured to move to the maintenance unit as necessary to undergo necessary maintenance.

(Ink Dryer Unit)

The ink dryer unit 50 dries a liquid component that remains on the sheet P after image recording. The ink dryer unit 50 comprises a transportation drum 51 that transports the sheet P, and an ink dryer 52 that performs a drying operation with respect to the sheet P transported by the transportation drum 51.

The transportation drum 51 receives the sheet P from the transfer barrel 86, and transports the sheet P while being rotated.

The ink dryer 52 is configured by a dryer (three dryers arranged along the transport path of the sheet P in this example), for example, and blows hot air toward the sheet P transported by the transportation drum 51 to dry the ink (evaporates the liquid component which is present on the sheet).

According to the ink dryer unit 50 configured as described above, the sheet P is transported by the transportation drum 51. Further, the hot air is blown to the recording surface from the ink dryer 52 in the transport process, so that the ink applied to the recording surface is dried.

The sheet P that passes through the ink dryer 52 is transferred to the transfer barrel 90 from the transportation drum 51. Further, the sheet P is transported by the transfer barrel 90, and is then transferred to the transportation drum 61 of the fixing unit 60.

As described above, the dryer 94 is provided in the transfer barrel 90, and hot air is blown toward the guide plate 93. Accordingly, the sheet P undergoes the drying process even in transportation of the transfer barrel 90.

(Fixing Unit)

The fixing unit 60 heats and presses the sheet P to fix an image recorded on the recording surface. The fixing unit 60 comprises a transportation drum 61 that transports the sheet P, heat rollers 62 and 63 that perform heating and pressing processes with respect to the sheet P transported by the transportation drum 61, and an inline sensor 64 that detects the temperature, humidity, and the like of the sheet P after recording and captures a recorded image.

The transportation drum 61 receives the sheet P from the transfer barrel 90, and transports the sheet P while being rotated.

The heat rollers 62 and 63 heat and press ink applied to the recording surface of the sheet P to weld a thermoplastic resin spread in the ink to form the ink into a coating. In addition, the heat rollers 62 and 63 correct deformation such as a cock ring or curl generated on the sheet P at the same time. Each of the heat rollers 62 and 63 is formed to have approximately the same width as that of the transportation drum 61, and is heated by an internal heater. Furthermore, each of the heat rollers 62 and 63 is pressed against and comes in contact with the outer circumferential surface of the transportation drum 61 by a pressing unit (not shown). The sheet P passes through the heat rollers 62 and 63, and is heated and pressed by the heat rollers 62 and 63.

The inline sensor 64 comprises a thermometer, a hygrometer, a CCD line sensor, or the like, and detects the temperature, humidity, and the like of the sheet P transported by the transportation drum 61, and captures an image recorded on the sheet. On the basis of the detection results of the inline sensor 64, abnormality of the device, discharge errors of the heads, or the like are checked.

According to the fixing unit 60 having the above-described configuration, the sheet P is transported by the transportation drum 61, and is pressed against and comes in contact with the heat rollers 62 and 63 in its recording surface in the transport process to be heated and pressed. Thus, the thermoplastic resin spread in the ink is welded so that the ink becomes a coating. Further, deformation generated in the sheet P at the same time is corrected.

The sheet P which undergoes the fixing process is transferred to the collection unit 70 from the transportation drum 61.

(Collection Unit)

The collection unit 70 accumulates and collects sheets P for which the series of recording processes is performed in a stacker 71. The collection unit 70 comprises the stacker 71 that collects the sheets P, and a discharge conveyor 72 that receives the sheet P which undergoes the fixing process in the fixing unit 60 from the transportation drum 61, and transports and discharges the sheet P to the stacker 71.

The sheet P which undergoes the fixing process in the fixing unit 60 is transferred to the discharge conveyor 72 from the transportation drum 61, and is transported to the stacker 71 by the discharge conveyor 72 to be collected in the stacker 71.

[Control System of Inkjet Recording Device]

Figure 11:
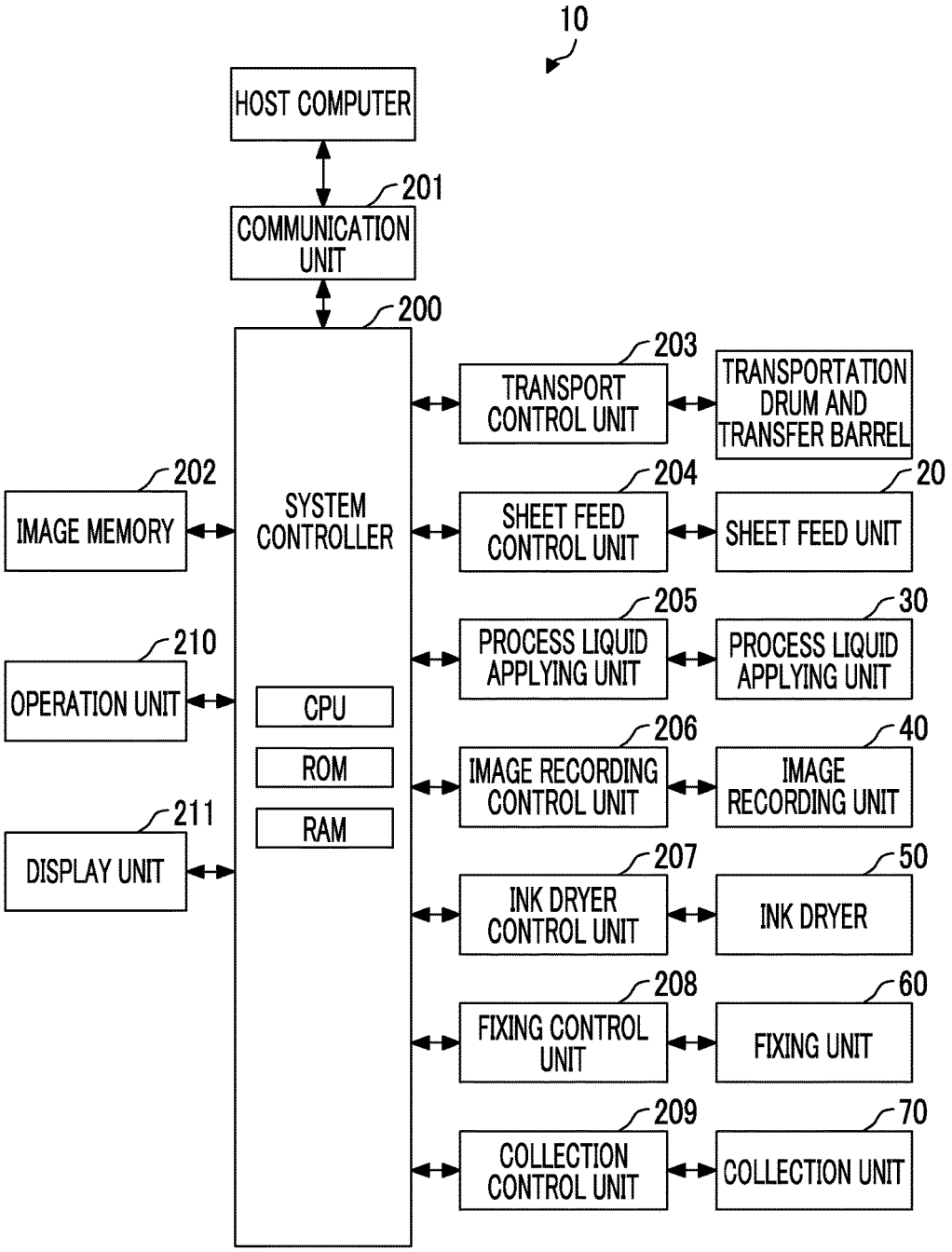
FIG. 11 is a block diagram illustrating a schematic configuration of a control system of the inkjet recording device 10.

FIG. 11 is a block diagram illustrating a schematic configuration of a control system of the inkjet recording device 10 according to this embodiment. As shown in FIG. 11, the inkjet recording device 10 comprises a system controller 200, a communication unit 201, an image memory 202, a transport control unit 203, a sheet feed control unit 204, a process liquid applying control unit 205, an image recording control unit 206, an ink dryer control unit 207, a fixing control unit 208, a collection control unit 209, an operation unit 210, a display unit 211, and the like.

The system controller 200 functions as a control unit for generally controlling the respective units of the inkjet recording device 10, and functions as a calculation unit for performing a variety of calculation processes. The system controller 200 comprises a CPU, a ROM, a RAM, and the like, and is operated according to a control program. In the ROM, a control program to be executed by the system controller 200 or a variety of data necessary for control is stored.

The communication unit 201 comprises a predetermined communication interface, and performs data transmission and reception between the communication interface and a connected host computer.

The image memory 202 functions as a temporary storage unit for a variety of data including image data, for which data reading and writing is performed through the system controller 200. Image data received from the host computer through the communication unit 201 is stored in the image memory 202.

The transport control unit 203 controls driving of the transportation drums 31, 41, 51, and 61 which are a transport unit of the sheet P in the respective units of the process liquid applying unit 30, the image recording unit 40, the ink dryer unit 50, and the fixing unit 60, and driving of the transfer barrels 80, 86, and 90. That is, the transport control unit 203 controls driving of a motor that drives each of the transportation drums 31, 41, 51, and 61, and driving of a motor that drives each of the transfer barrels 80, 86, and 90.

Further, the transport control unit 203 controls driving of a vacuum pump for suctioning and holding the sheet P on the outer circumferential surface of each of the transportation drums 31, 41, 51, and 61, and controls driving (a thermal dose and a blast volume) of the dryers 84, 89, and 94 respectively provided in the transfer barrels 80, 86, and 90.

The driving of the transportation drums 31, 41, 51, and 61, and the driving of the transfer barrels 80, 86, and 90 are controlled according to commands from the system controller 200.

The sheet feed control unit 204 controls driving of the respective units (the sheet feeder 21, the transfer barrel 23, and the like) that form the sheet feed unit 20 according to commands from the system controller 200.

The process liquid applying control unit 205 controls driving of the respective units (the process liquid applier 32, and the like) that form the process liquid applying unit 30 according to commands from the system controller 200.

The image recording control unit 206 controls driving of the respective units (the sheet pressing roller 42, the inkjet heads 44C, 44M, 44Y, and 44K, and the like) that form the image recording unit 40 according to commands from the system controller 200.

The ink dryer control unit 207 controls driving of the respective units (the ink dryer 52, and the like) that form the ink dryer unit 50 according to commands from the system controller 200.

The fixing control unit 208 controls driving of the respective units (the heat rollers 62 and 63, the inline sensor 64, and the like) that form the fixing unit 60 according to commands from the system controller 200.

The collection control unit 209 controls driving of the respective units (the sheet discharge conveyor 72, and the like) that form the collection unit 70 according to commands from the system controller 200.

The operation unit 210 comprises a predetermined operation unit (for example, operation buttons, a keyboard, a touch panel, or the like), and outputs operation information input through the operation unit to the system controller 200. The system controller 200 executes a variety of processes according to the operation information input through the operation unit 210.

The display unit 211 comprises a predetermined display device (for example, an LCD panel), and displays predetermined information on the display device according to a command from the system controller 200.

Further, as described above, image data to be recorded on the sheet P is received in the inkjet recording device 10 from a host computer through the communication unit 201, and is stored in the image memory 202. The system controller 200 performs predetermined signal processing with respect to the image data stored in the image memory 202 to generate dot data, and control driving of each of the inkjet heads of the image recording unit 40 according to the dot data, to thereby record an image indicated by the image data on a sheet.

The dot data is generally generated by performing a color conversion process and a halftone process with respect to image data. The color conversion process is a process of converting image data indicated by sRGB or the like (for example, RGB 8-bit image data) into data on the amount of ink of respective colors to be used in the inkjet recording device 10 (in this example, into ink amount data on respective colors of C, M, Y, and K). The halftone process is a process of converting ink amount data on respective colors generated by the color conversion process into dot data of the respective colors using a process such as error diffusion.

The system controller 200 performs the color conversion process and the halftone process with respect to image data to generate dot data on the respective colors. Further, the system controller 200 controls driving of corresponding inkjet heads according to the generated dot data of the respective colors, to thereby record an image indicated by the image data on a sheet.

[Recording Operation of Inkjet Recording Device]

Next, a recording operation in the inkjet recording device 10 will be described.

If a sheet feed command is output to the sheet feeder 21 from the system controller 200, a sheet P is fed to the sheet feed tray 22 from the sheet feeder 21. The sheet P fed to the sheet feed tray 22 is transferred to the transportation drum 31 of the process liquid applying unit 30 through the transfer barrel 23.

The sheet P transferred to the transportation drum 31 is transported by the transportation drum 31, and passes through the process liquid applier 32 in the transport process, so that the liquid process is applied to a recording surface thereof.

The sheet P to which the process liquid is applied is transferred to the transfer barrel 80 from the transportation drum 31, is transported by the transfer barrel 80, and is then transferred to the transportation drum 41 of the image recording unit 40. Further, hot air is applied to the recording surface of the sheet P from the dryer 84 provided inside the transfer barrel 80 in the transport process using the transfer barrel 80, so that the process liquid applied to the recording surface is dried.

The sheet P transferred to the transportation drum 41 from the transfer barrel 80 is first nipped by the sheet pressing roller 42 while passing through the sheet pressing roller 42 to be in close contact with the outer circumferential surface of the transportation drum 41. Ink droplets of the respective colors of C, M, Y, and K are jetted from the inkjet heads 44C, 44M, 44Y, and 44K. Thus, a color image is drawn on the recording surface. The sheet P on which the image is drawn is transferred to the transfer barrel 86 from the transportation drum 41.

The sheet P transferred to the transfer barrel 86 is transported by the transfer barrel 86, and is then transferred to the transportation drum 51 of the ink dryer unit 50. Further, hot air is applied to the recording surface from the dryer 89 provided inside the transfer barrel 86 in the transport process, so that the ink applied to the recording surface is dried.

The sheet P transferred to the transportation drum 51 is transported by the transportation drum 51, and hot air is applied to the recording surface from the ink dryer 52 in the transport process, so that a liquid component that remains on the recording surface is dried.

The sheet P which undergoes the drying process is transferred to the transfer barrel 90 from the transportation drum 51, is transported by the transfer barrel 90, and is then transferred to the transportation drum 61 of the fixing unit 60. Further, hot air is applied to the recording surface from the dryer 94 provided inside the transfer barrel 90 in the transport process using the transfer barrel 90, so that the ink applied to the recording surface is dried again.

The sheet P transferred to the transportation drum 61 is transported by the transportation drum 61, and is heated and pressed by the heat rollers 62 and 63 in the transport process, so that the image recorded on the recording surface is fixed. Then, the sheet P is transferred to the sheet discharge conveyor 72 of the collection unit 70 from the transportation drum 61, and is then transported to the stacker 71 by the sheet discharge conveyor 72 to be discharged in the stacker 71.

As described above, in the inkjet recording device 10, the sheet P is transported using the drums, various processes such as application of a process liquid, drying of the process liquid, jetting of ink droplets, drying, and fixing are performed with respect to the sheet P in the transport process, so that an image is recorded on the sheet P. Particularly, by using the recording medium transport device shown in FIG. 2 in the transportation drums 31, 41, 51, and 61, it is possible to appropriately transport the sheet P to record an image thereon.

A technical scope of the invention is not limited to the scope disclosed in the above-described embodiments. The configurations or the like in the respective embodiments may be appropriately combined between the respective embodiments as long as the combination does not depart from the scope of the invention.

EXPLANATION OF REFERENCES

100: sheet transportation device
110: drum
112: rotating shaft
114*a*, 114*b*: gripper (grip unit)
122: long groove
124: suction passage
126: round hole
128: tube
130: rotating vacuum chamber
132: valve
134: hollow portion
136: stop vacuum chamber
138: pump
140: hole portion
150: acquisition unit
152: determination unit
154: motor
156: control unit
D: suction position
$D_S$: suction starting position
$D_E$: suction ending position
$L_D$: distance between DS and DE
$L_P$: length of sheet P in circumferential direction of drum 110
P: sheet
PA: sheet transported on A surface
$PA_R$: trailing edge of sheet PA
PB: sheet transported to B surface
$PB_F$: leading edge of sheet PB

What is claimed is:

1. A recording medium transportation device comprising:

a cylindrical portion that holds a recording medium in a holding region on an outer circumferential surface thereof and is rotated around a shaft, and that has a suction position positioned in a predetermined direction from a position of the shaft;

a plurality of suction holes that is disposed in the holding region;

a suction unit for suctioning the recording medium through suction holes disposed at the suction position among the plurality of suction holes;

an adjustment unit disposed between the plurality of suction holes and the suction unit, the adjustment unit capable of adjusting a suction flow rate of each suction hole;

an acquisition unit for acquiring a thickness of the recording medium to be held in the holding region;

a determination unit for determining whether an acquired thickness is equal to or greater than a first threshold value; and a control unit for controlling a plurality of adjustment unit to set the suction flow rate of each suction hole when the holding region is present at the suction position, that sets as a first suction flow rate, a suction flow rate of a suction hole disposed in a subsequent region other than a leading edge which is a preceding region according to rotation of the cylindrical portion in the holding region, and sets, as a second suction flow rate which is smaller than the first flow rate, a suction flow rate of a suction hole disposed in the leading edge in a case where the acquired thickness is equal to or greater than the first threshold value, and sets, as a third suction flow rate which is smaller than the first flow rate, a suction flow rate of a suction hole disposed in the holding region in a case where the acquired thickness is smaller than the first threshold value, wherein the cylindrical portion comprises a plurality of suction passages which extends from a side surface of the cylindrical portion in an axial direction of the cylindrical portion inwards from the outer circumferential surface of the cylindrical portion and communicates with the suction holes, which is arranged along a circumferential direction of the cylindrical portion, wherein the suction unit comprises a vacuum chamber that communicates with a suction passage corresponding to a suction hole at the suction position among the plurality of suction passages, and a pump that evacuates the vacuum chamber, wherein the adjustment unit comprises a plurality of valves that is respectively disposed between the plurality of suction passages and the vacuum chamber, and wherein where the number of holding regions is represented as n, the radius of the cylindrical portion is represented as r, a circumferential length of the recording medium to be held in the holding region is represented as $L_P$, and a circumferential length of the suction position on the cylindrical portion is represented as $L_D$, the leading edge region is a region ranging from a preceding end portion according to rotation of the cylindrical portion in the holding region to a position spaced apart therefrom by a distance $L_N$ expressed by $L_N=L_D+L_P-2\pi/n$ along the circumferential direction of the cylindrical portion.

2. The recording medium transportation device according to claim 1, wherein the vacuum chamber comprises:

a first vacuum chamber that communicates with each of the plurality of suction passages and is rotated according to rotation of the cylindrical portion, and a second vacuum chamber that communicates with a suction passage disposed at the suction position among the plurality of suction passages that communicates with the first vacuum chamber.

3. The recording medium transportation device according to claim 2, wherein the second suction flow rate is equal to or greater than ⅙ of the first suction flow rate and is equal to or smaller than ½ of the first suction flow rate.

4. The recording medium transportation device according to claim 3, wherein the determination unit determines whether the acquired thickness is equal to or greater than a second threshold value which is smaller than the first threshold value, and wherein the control unit sets the suction flow rate of the suction hole disposed in the holding region as a fourth suction flow rate which is smaller than the second suction flow rate and the third suction flow rate in a case where the acquired thickness is smaller than the second threshold value.

5. The recording medium transportation device according to claim 2, wherein the determination unit determines whether the acquired thickness is equal to or greater than a second threshold value which is smaller than the first threshold value, and wherein the control unit sets the suction flow rate of the suction hole disposed in the holding region as a fourth suction flow rate which is smaller than the second suction flow rate and the third suction flow rate in a case where the acquired thickness is smaller than the second threshold value.

6. The recording medium transportation device according to claim 2, wherein the acquisition unit comprises an input unit through which the thickness of the recording medium to be held in the holding region is input.

7. The recording medium transportation device according to claim 1, wherein the second suction flow rate is equal to or greater than ⅙ of the first suction flow rate and is equal to or smaller than ½ of the first suction flow rate.

8. The recording medium transportation device according to claim 7, wherein the determination unit determines whether the acquired thickness is equal to or greater than a second threshold value which is smaller than the first threshold value, and wherein the control unit sets the suction flow rate of the suction hole disposed in the holding region as a fourth suction flow rate which is smaller than the second suction flow rate and the third suction flow rate in a case where the acquired thickness is smaller than the second threshold value.

9. The recording medium transportation device according to claim 1, wherein the determination unit determines whether the acquired thickness is equal to or greater than a second threshold value which is smaller than the first threshold value, and wherein the control unit sets the suction flow rate of the suction hole disposed in the holding region as a fourth suction flow rate which is smaller than the second suction flow rate and the third suction flow rate in a case where the acquired thickness is smaller than the second threshold value.

10. The recording medium transportation device according to claim 1, wherein the acquisition unit comprises an input unit through which the thickness of the recording medium to be held in the holding region is input.

11. The recording medium transportation device according to claim 1, wherein the acquisition unit comprises a sensor that measures the thickness of the recording medium to be held in the holding region.

12. The recording medium transportation device according to claim 1, further comprising:

a grip unit for gripping a preceding end portion of the recording medium according to rotation of the cylindrical portion.

13. The recording medium transportation device according to claim 1, wherein the cylindrical portion holds the recording medium in each of a plurality of holding regions.

14. An image forming apparatus comprising:

the recording medium transportation device according to claim 1;

an inkjet head that is provided to face the suction position; and a recording unit for recording an image by discharging ink from the inkjet head onto a recording medium held in the holding region on the outer circumferential surface of the cylindrical portion.

15. A recording medium transportation method for using in the recording medium transportation device according to claim 1, using a cylindrical portion that holds a recording medium in a holding region on an outer circumferential surface thereof and is rotated around a shaft, and that has a plurality of suction holes in the holding region and a suction position positioned in a predetermined direction from the position of the shaft, the method comprising:

an acquisition step of acquiring a thickness of the recording medium to be held in the holding region;

a determination step of determining whether an acquired thickness is equal to or greater than a first threshold value;

a setting step of setting a suction flow rate of each suction hole when the holding region is present at the suction position, the setting step including setting, as a first flow rate, a suction flow rate of a suction hole disposed in a subsequent region other than a leading edge which is a preceding region according to rotation of the cylindrical portion in the holding region and setting, as a second flow rate which is smaller than the first flow rate, a suction flow rate of a suction hole disposed in the leading edge in a case where the acquired thickness is equal to or greater than the first threshold value, and setting, as a third flow rate which is smaller than the first flow rate, a suction flow rate of a suction hole disposed in the holding region in a case where the acquired thickness is smaller than the first threshold value; and a transportation step of rotating the cylindrical portion with the recording medium being held in the holding region to suction the recording medium through suction holes at the suction position among the plurality of suction holes.

* * * * *